US005692746A

United States Patent [19]

Herrick, Jr.

[11] Patent Number: 5,692,746

[45] Date of Patent: Dec. 2, 1997

[54] SHEET ROTATOR AND JUSTIFIER

[75] Inventor: Robert F. Herrick, Jr., Deep River, Conn.

[73] Assignee: Roll Systems, Inc., Burlington, Mass.

[21] Appl. No.: 512,605

[22] Filed: Aug. 8, 1995

[51] Int. Cl.[6] ..... B65H 9/16

[52] U.S. Cl. ..... 271/251; 271/248; 271/253

[58] Field of Search ..... 271/248, 250, 271/251, 253, 254

[56] References Cited

U.S. PATENT DOCUMENTS

| | | | |
|---|---|---|---|
| 3,980,296 | 9/1976 | Craft et al. | 271/251 |
| 4,669,719 | 6/1987 | Fratangelo | 271/251 |
| 4,836,119 | 6/1989 | Siraco et al. | 271/251 |
| 5,114,137 | 5/1992 | Olson | 271/251 |
| 5,280,903 | 1/1994 | Herrick | 271/248 |
| 5,342,040 | 8/1994 | Markgraf | 271/251 |

FOREIGN PATENT DOCUMENTS

| | | | |
|---|---|---|---|
| 0062138 | 4/1986 | Japan | 271/251 |
| 376554 | 7/1932 | United Kingdom | 271/250 |
| 2175573 | 12/1986 | United Kingdom | 271/248 |

*Primary Examiner*—H. Grant Skaggs
*Attorney, Agent, or Firm*—Cesari and McKenna, LLP

[57] ABSTRACT

A sheet justifier provides a table having at least one rotational surface thereon that is substantially aligned with the table. A sheet is input to the table into contact with the rotational surface. A weighted ball is positioned over the rotating surface proximate an outer edge of the rotating surface. The sheet is grasped between the ball and the rotating surface and forced against a raised guide edge. Once the sheet is forced against the guide edge, all rotational driving force is translated in a downstream direction there along so that the sheet is driven out of the guide edge with its edge aligned therewith in a justified orientation. A rotator can be provided to the sheet justifier according to this invention. The rotator can include one or more weighted balls that engage a rotating surface at points remote from an axis of rotation of the rotating surface and rotate a corner of the sheet 90° as the corner passes through a gap between an upstream and a downstream portion of an edge guide. Sheets are received from the rotator by a justifier for transport further downstream.

30 Claims, 22 Drawing Sheets

SHEET ROTATOR AND JUSTIFIER

FIELD OF THE INVENTION

The present invention relates to a device for rotating and justifying input sheets.

BACKGROUND OF THE INVENTION

It is often desirable to transfer sheets of, for example, paper between two devices, such as a printer and a further utilization device (e.g. a folder) without the need of a complex conveyor system. In general, such a conveyor system is necessary to prevent misalignment of sheet edges as they pass from one device to another. Misalignment of sheets can cause jams or otherwise lower the quality of the finished product.

Many printers and other sheet handling devices include ports from which sheets are output in serial order. Absent a complex coupling from the port to a further utilization device, these ports cannot be relied upon to output sheets in an aligned and justified manner. In addition, sheets are often fed to a common path from a pair of slit and merged web. In this instance, sheet justification is highly desirable. A user may also desire manual input of sheets to a device. A justifier can guarantee aligned feeding even when sheets are input rapidly by the user's hand.

It is also desirable to rotate sheets from one orientation (for example, landscape) to another orientation (for example, portrait) between two or more utilization devices. A sheet can be cut from a web in landscape configuration and, subsequently, fed to a downstream utilization device for printing and portrait configuration. Sheet rotators are employed for this purpose. Many prior art rotators are complicated and prone to jamming.

It is therefore an object of this invention to provide a sheet justifier that can receive misaligned sheets from a port or other source, such as manual input, and aligned the edges of the sheets in a uniform justified manner. It is a further object of this invention to provide a sheet justifier that can be adapted to receive sheets from a variety of sources and that can be adapted to output sheets to a variety of utilization devices. It is yet another object of this invention to provide a sheet justifier that operates with increased reliability.

It is a further object of this invention to provide a rotator that can be used in conjunction with the sheet justifier of this invention. The rotator should be relatively simple to operate and maintain. The rotator should be capable of rotating sheets having a variety of sizes and shapes.

SUMMARY OF THE INVENTION

A sheet justifier according to this invention provides a supporting surface in the form a table having opposing ends for receiving sheets from an upstream port and outputting sheets to a downstream utilization device. A raised edge guide is provided along a substantial portion of one edge of the table, running along a sheet flow direction from upstream to downstream. A rotating surface, typically a disk, is provided adjacent the edge guide and substantially coplanar with the table surface. Near the outer edge of the disk, slightly upstream and adjacent the edge guide is provided a freely rotating mass such as a ball that is stationary relative to the disk but rotates in place in response to and following the rotation of the disk. An input sheet passing downstream between the ball and the disk is forced by the component of force perpendicular to the flow direction against the edge guide. The downstream component of force generated by disk rotation simultaneously forces the sheet to move downstream. The perpendicular component maintains the sheet against the edge and, thus, causes it to be output in a parallel justified orientation.

A plurality of rotating surfaces and balls can be aligned along the table to insure full justification of the sheet. The raised edge can be movable, as can the other justifier components, to produce jog offset sheets at selected times.

Additionally, a second freely rotating mass, such as a ball, can be provided between the axis of rotation and the more outwardly disposed ball in order to enable rotation of sheets so that each of their sides engage the raised edge guide. The second more inwardly disposed ball can be selectively applied to sheets to allow rotation of the sheet through a desired number of edges so that a desired orientation is obtained.

A sheet rotator is also provided according to this invention. The sheet rotator includes a supporting surface that supports sheets that includes an upstream end for receiving sheets and a downstream end for outputting sheets. The rotating surface is approximately coplanar with the supporting surface and is generally located adjacent to supporting surface near an edge of the supporting surface. The rotating surface rotates on a axis that is substantially perpendicular to the supporting surface. A raised edge guide is provided at a position upstream of the rotating surface and also at a position downstream of the rotating surface. The raised edge guide can include a pair of end walls that are remotely positioned from each other and that define a gap in the area of the rotating surface. A mass, that can comprise a freely rotating mass, roller or ball, contacts the rotating surface at a position remote from an axis rotation of the rotating surface. The mass is positioned so that each of the sheets entering from the upstream end and that pass through the contact point are provided with a rotational moment. The rotational moment moves an upstream end of each of the sheets away from the edge guide and causes a forward-facing edge of each of the sheets to rotate toward the edge guide at a location downstream of the rotating surface. A corner of the sheet is typically driven into the gap to facilitate rotation as a portion of the sheet engages an upstream end wall of the edge guide at the gap.

Justifier rotating surfaces and corresponding justifier masses, which can be freely rotating, can be provided upstream and downstream of the rotating surface. The upstream and downstream justifiers are located to deliver the sheets to the rotating surface and to receive rotated sheets from the rotating service. The justifiers can be adjustable relative to the rotating surface so that different sized sheets can be delivered to, and received from, the rotating surface.

The supporting surface can be constructed as a free-standing structure with a base that enables upward and downward movement of the upstream end and the downstream end of the supporting surface to enable use of the rotator of this invention with a variety of different utilization devices having differing port elevations.

A plurality of masses can be used in conjunction with the rotating surface. These masses can comprise freely rotating rollers or balls having centers of rotation aligned along the line that is approximately perpendicular to the downstream direction. The freely rotating masses can be supported within holders that can be disengaged from contact with the rotating surface. In one embodiment, either, or both, of a pair of freely rotating masses can be disengaged to vary the rotating force, to disengage the rotating force entirely. The rotating surface can rotate in a direction opposite the justifying rotating surfaces. A series of belts can be used to drive the rotating surface and justifying rotating surfaces from a common drive motor.

A method for rotating sheets according to this invention provides the step of directing sheets along an edge guide to a rotating surface. The sheets are engaged between the rotating surface and a mass that contacts the rotating surface at a position remote from an axis of rotation of the rotating surface. The rotating surface generates components of force at a contact point between the mass and the rotating surface that rotates each of the sheets in an area adjacent a respective corner of each of the sheets. The sheets are received at a downstream portion of the edge guide from whence the sheets are driven downstream away from the rotating surface.

BRIEF DESCRIPTION OF THE DRAWINGS

The foregoing objects and other advantages of the invention will become more clear with reference to the following detailed description of the preferred embodiments as illustrated by the drawings in which.

DETAILED DESCRIPTION

Figure 1:
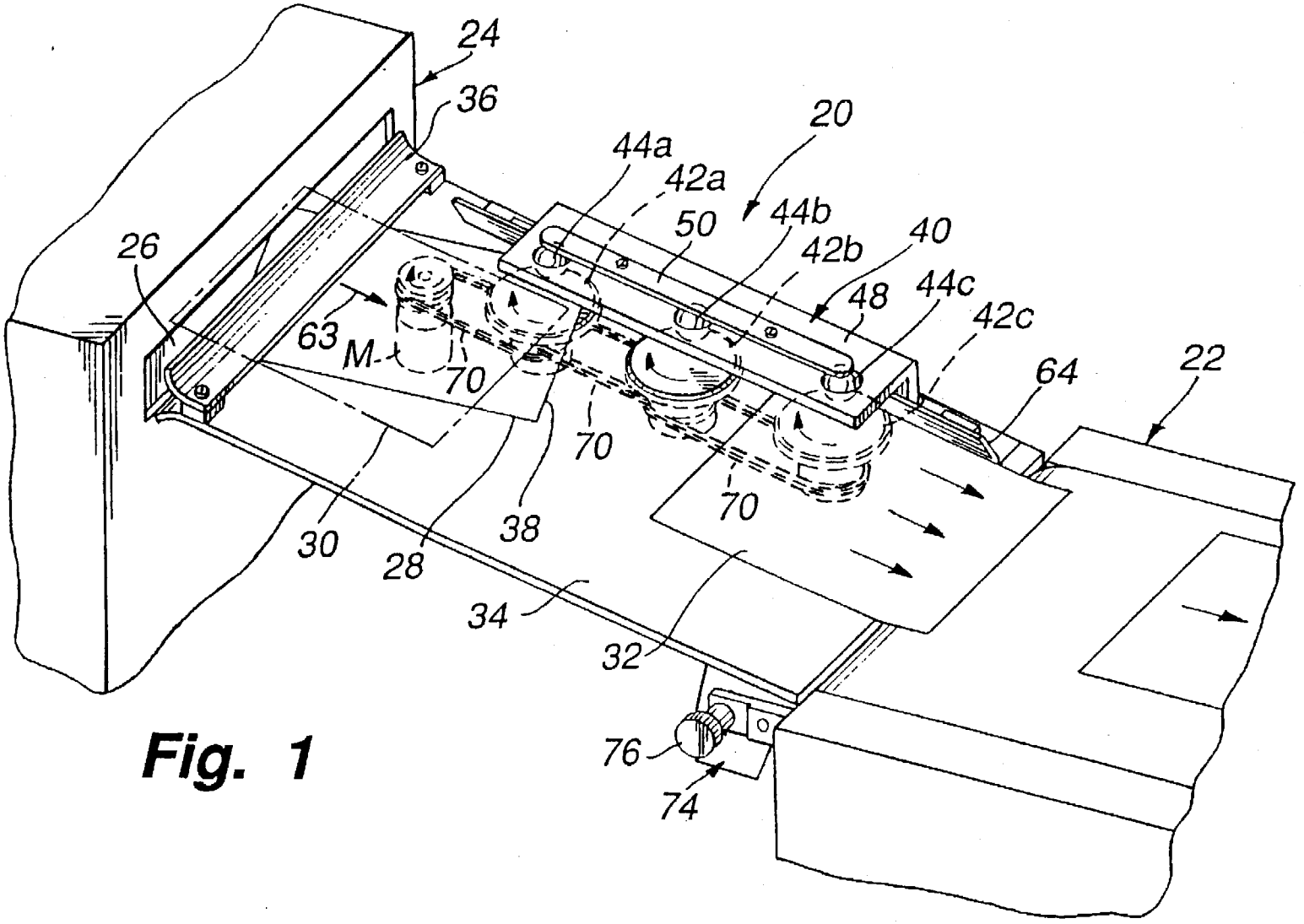
FIG. 1 is a perspective view of a sheet justifier according to a preferred embodiment.
Figure 2:
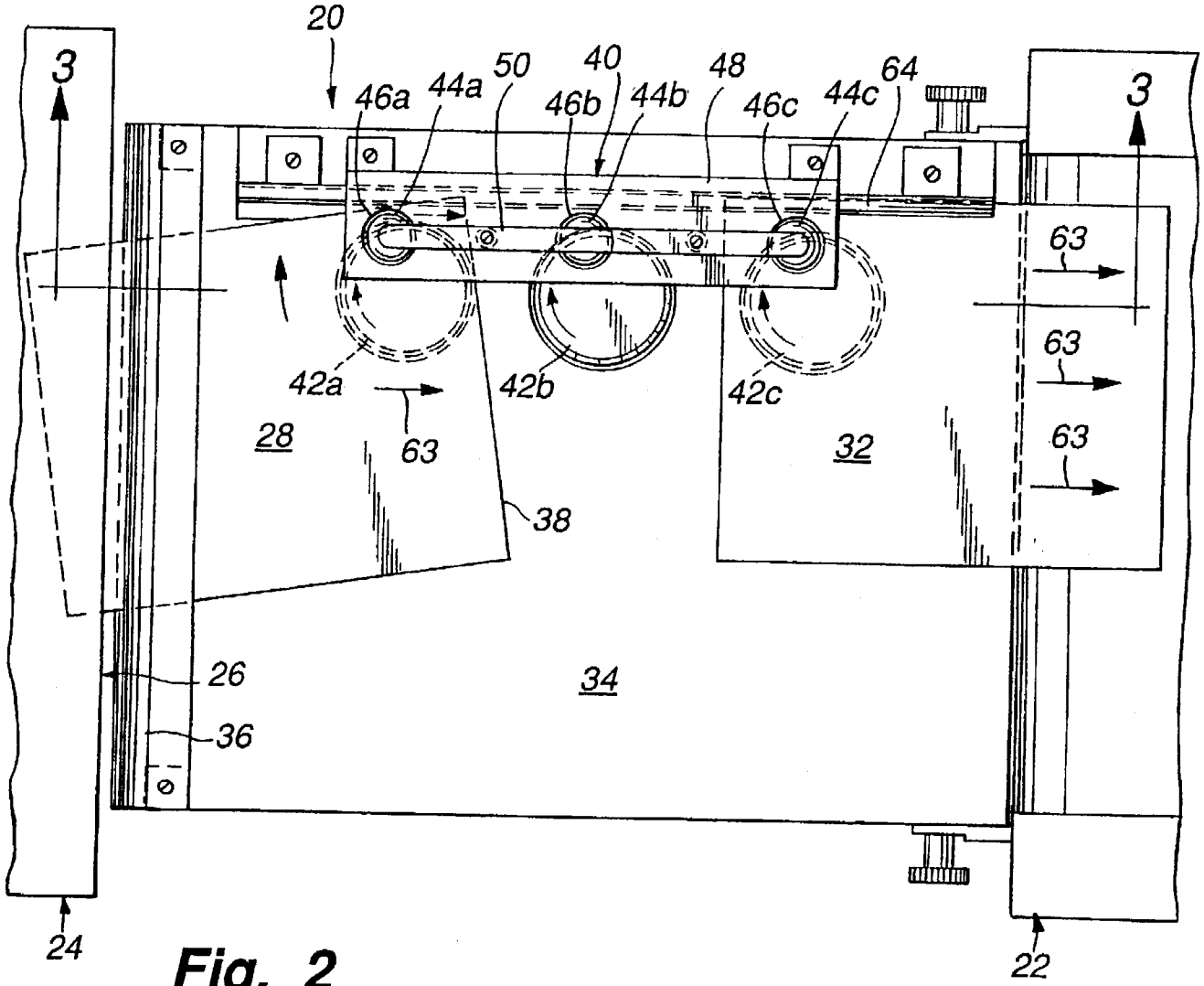
FIG. 2 is an exposed top view of the sheet justifier of FIG. 1.
Figure 3:
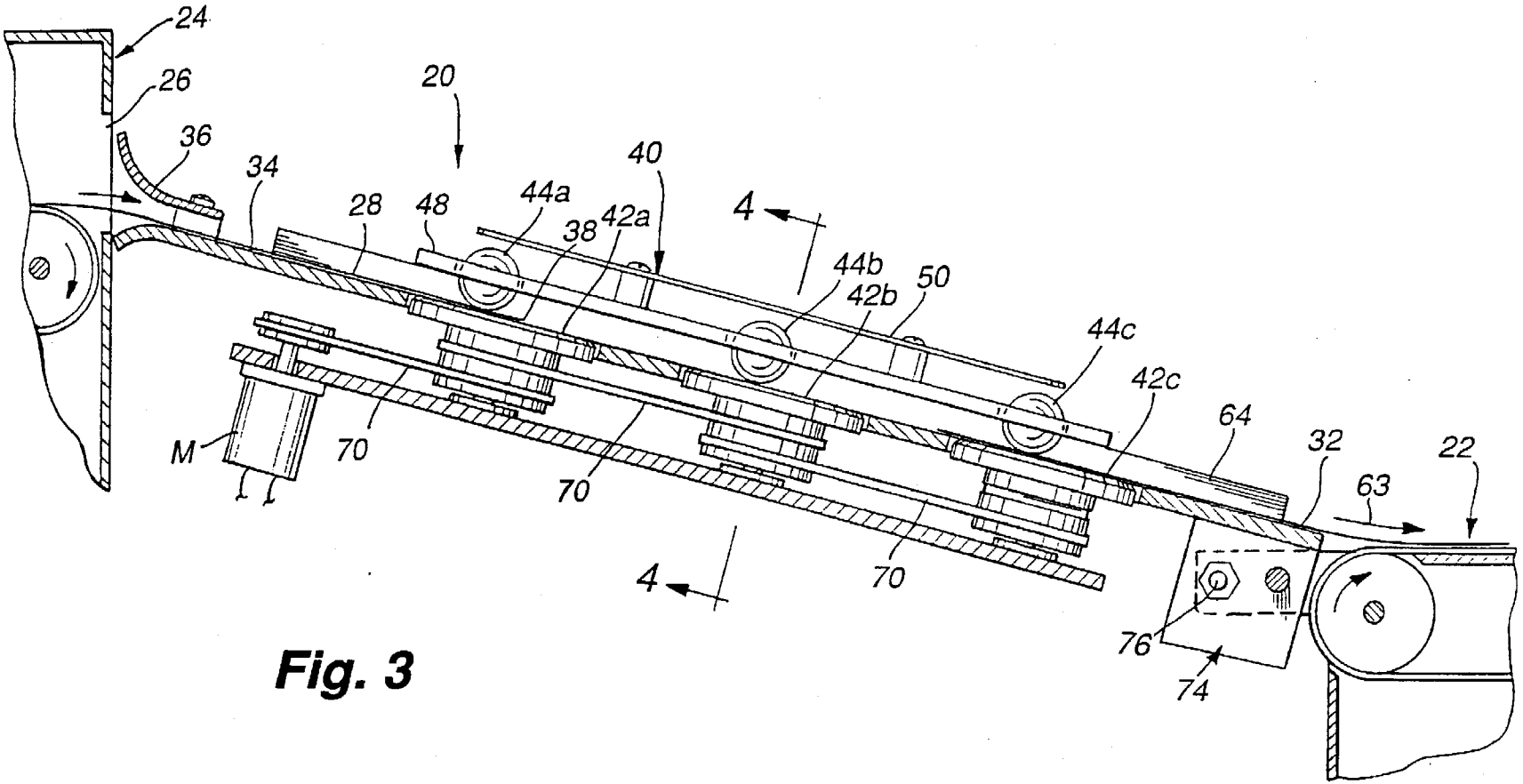
FIG. 3 is a side cross section of the sheet justifier taken along the line 3—3 of FIG. 2.
Figure 4:
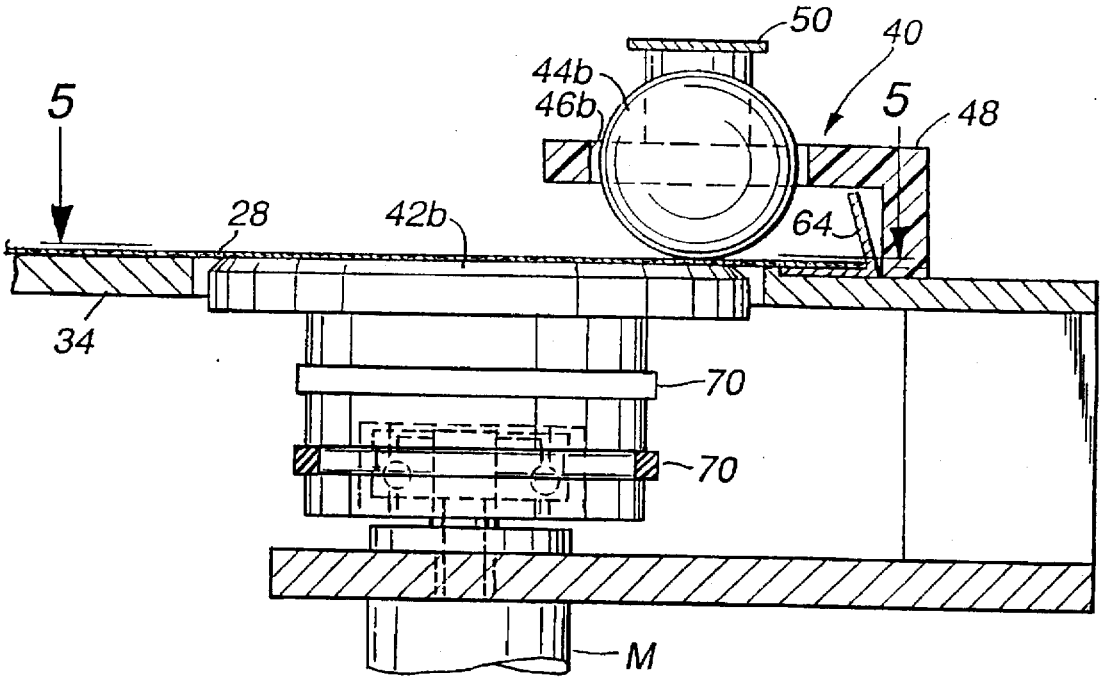
FIG. 4 is a partial cross-sectional rear view of the sheet justifier viewed in an upstream direction detailing the rotating disk and ball structure.

FIGS. 1–4 detail a sheet justifier 20 according to this invention. The sheet justifier 20 is mounted on a utilization device 22 positioned downstream of another device 24 such as a printer having a port 26 that ejects sheets therefrom in a serial manner. As noted above, it is normally desirable to accurately register a sheet leaving a port and entering a utilization device 22. In this example, a sheet 28 has been output from the upstream port 26 in a somewhat crooked orientation (note the justified orientation of the sheet 30 shown in phantom). Without the use of a sheet justifier, the crooked sheet 28 would most likely jam or otherwise cause a defective output at the utilization device 22. The sheet justifier 20 in this embodiment straightens the sheet 28 so that it enters the utilization device 22 in a proper parallel orientation as exemplified by the downstream sheet 32.

The justifier 20 comprises a feeding table 34 constructed, for example, of sheet metal and defining a substantially flat surface over which sheets can pass. The table 34 has a funnel structure 36 at its upstream end. The funnel structure 36 helps to insure that the sheet leading edge 38 is guided onto the table surface of the justifier 20 as it exits the port. The crooked sheet 28 is driven out of the port under the driving power of the upstream device 24 approximately until it reaches the justifier mechanism 40. At such a time, the leading edge 38 of the sheet 28 is engaged by the justifier mechanism 40 and the sheet is moved into justified registration.

The justifier mechanism 40 according to this embodiment comprises three rotating disks 42*a*–*c* that have surfaces positioned approximately on level with the justifier table 34 through holes 44*a*–*c* provided in the table surface. While circular disks 42*a*–*c* are employed in this example, a variety of geometric shapes can be utilized and are contemplated according to this invention. Each disk 42*a*–*c* includes at a position over its surface a weighted ball 44*a*–*c* that comprises, in this example, a three-quarter inch diameter ball bearing that bears against the rotating disk surface. It is between the ball bearing and the disk that the leading edge of the sheets are grasped by the mechanism and it is by means of the positional interrelationship between the weighted ball bearing and the disk that the sheets are brought into registered alignment. While a ball bearing is used according to this embodiment, it should be understood that "ball" as used herein shall refer to any structure that rotates freely and/or can resolve rotation into two or more degrees of freedom to follow the movement of a sheet thereunder, such as a roller on gimbles (not shown).

Each ball bearing 44*a*–*c* is, itself, mounted within a corresponding hole 46*a*–*c* in a framework 48 that allows the balls 44*a*–*c* to rotate in all degrees of freedom. A bar 50 can be provided on the framework 48 above the ball bearings 44*a*–*c* to prevent them from popping out of their holes 46*a*–*c* in the framework 48. Space should be provided between the bar 50 and the top of each ball bearing 44*a*–*c* so that a large variation in thicknesses of sheets can be accommodated by the justifier mechanism 40 without causing the ball bearing tops to rub against the bar 50.

Figure 5:
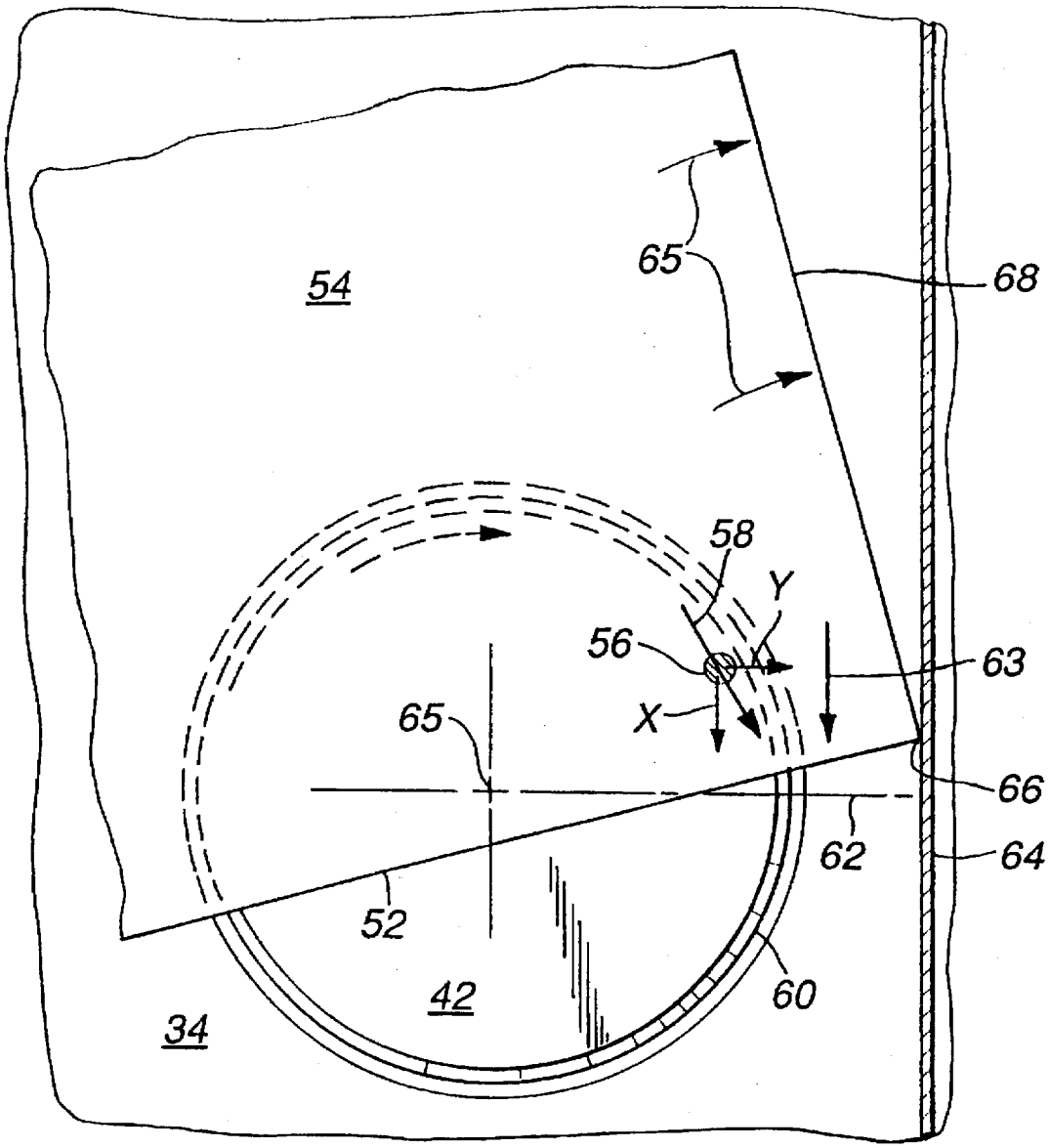
FIG. 5 is a somewhat schematic top view illustrating the justification of a sheet by a rotating disk and ball according to this invention.

Referring now to FIG. 5, it illustrates the principle governing the justification of sheets according to this invention. When the leading edge 52 of a sheet 54 is grasped between the ball bearing 44 and the moving surface of disk 42, the friction of the disk surface proximate the contact point 56 of the ball bearing 44 causes an immediate tangential movement of this sheet 54 relative to the disk 42 as shown by the arrow 58. The ball bearing (not shown) serves to concentrate the grip of the sheet 54 by the disk 42 at the contact point 56 while the remaining disk surface slides relative to the sheet. Thus, the sheet 54 is driven by the localized movement of the disk 42 at the contact point 56. The contact point 56 of the ball bearing 44 in this embodiment should be placed near the outer edge 60 of the disk 42 and upstream of a line 62 taken through the center axis 65 of the disk and perpendicular to the direction of the sheet flow shown by the arrow 63. In this embodiment, a 2½ to 3 inch disk can be utilized in which the contact point is positioned ½ to 1 inch upstream of the diameter line 62.

The sheet justifier 20 according to the embodiment of FIGS. 1–4 and as shown in FIG. 5 includes a raised vertical edge guide 64 running almost the full length of the table 34. The edge guide 64 is parallel to the direction of sheet flow (arrow 63). The edge guide 64 slants inwardly toward the sheets in this embodiment to maintain the edges of sheets moving there along firmly against the table surface. As shown in FIG. 5, the raised edge guide is a block that prevents the corner 66 of the sheet 54 from moving further along the tangent (arrow 58) direction of disk rotation. As such, as the disk continues to rotate, the sheet is, itself, caused to rotate (arrows 65) inwardly toward the raised edge guide 64. This is because the sheet is driven almost entirely at the contact point of the ball bearing. The rotationally generated tangential force of the disk can be resolved into perpendicular force vectors X and Y emanating from the contact point as shown. The force vector Y perpendicular to the edge guide 64 causes the sheet to move its side edge 68 into contact with the raised edge guide 64. Simultaneously, the force vector X causes sheet motion along the flow direction (arrow 63). Since sheet movement generated by the force vector Y is blocked by the edge guide 64 once the sheet edge 68 has moved fully into contact with the edge guide 64, only the downstream directed vector X can act upon the sheet once it has rotated against the edge guide 64.

Figure 6:
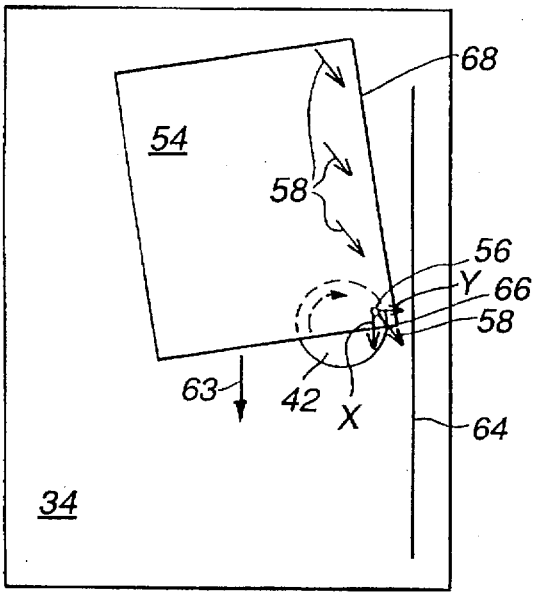
FIGS. 6–9 are somewhat schematic top views of a justification sequence for a sheet using a rotating disk and ball structure according to this invention.

The full sequence of sheet justification is further detailed in FIGS. 6–9. A sheet 54 starts in a spaced apart relation from the raised edge guide 54 in FIG. 6. At this time, the sheet 64 moves along a direction of tangent to the rotation of the disk 42 (arrow 58) relative to the contact point 56 (FIG. 6).

Figure 7:
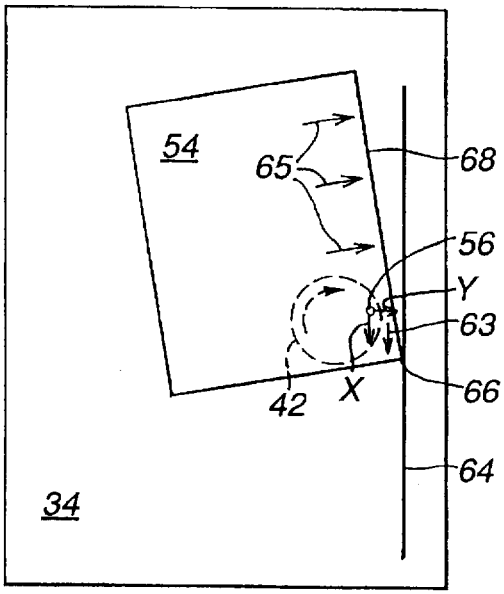
Figure 8:
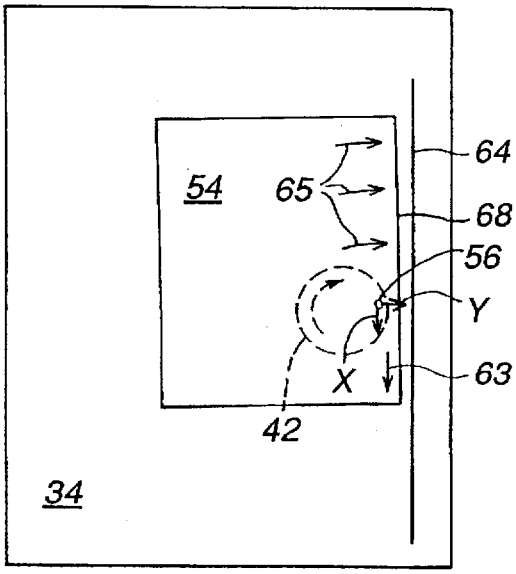
Figure 9:
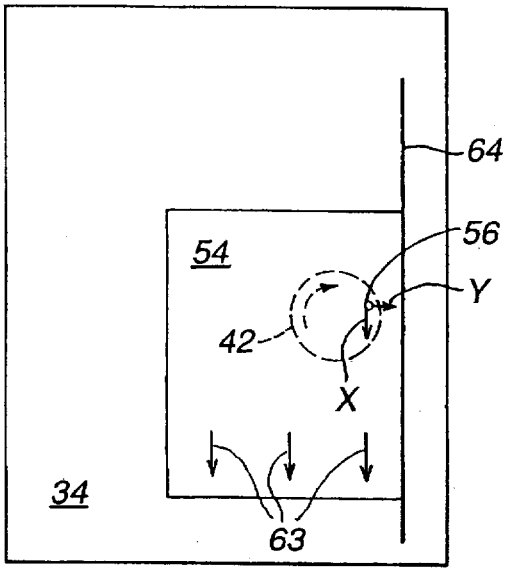

In FIG. 7, the leading corner 66 of the sheet 54 has reached the edge guide 64 and tangential movement is no longer possible, at this time, the perpendicular force vector Y serves to rotate the upstream portion of the sheet side edge 68 toward the raised edge guide 64 as shown by the arrows 65. The movement of the side edges toward the raised edge continues in FIG. 8 until, finally, in FIG. 9 the sheet is brought fully into contact with the raised edge guide without further movement. Only the downstream vector X can act on the sheet at this time since the perpendicular vector Y is forcing the sheet fully against the raised edge guide 64.

The spacing of the raised edge guide 64 from the disk 42 and contact point 56 should be such that the sheet 54 cannot buckle therebetween in spite of the force generated by the perpendicular vector Y. This distance value will vary, therefore, based upon the coefficient friction of the disk surface, the weight of the ball, the general stiffness of the sheet stock utilized and the inward slant of the raised edge guide 64. In other words, for very high friction surface or very thin sheet stock, the spacing between the raised edge guide 64 and the contact point 56 must be fairly close to prevent buckling. Conversely, for thicker sheet stock and/or a lower friction surface, a larger spacing can be tolerated.

In this embodiment, the disk surface includes a polyurethane coating that provides a reasonably good frictional contact with the sheets but that also allow some slippage so that sheets do not tend to buckle at the raised edge. A variety of friction enhancing surface coatings and materials are contemplated.

Referring once again to FIGS. 1–4, the justifier mechanism 40 according to this embodiment includes three rotating disks **42*a–c* aligned along the direction of sheet flow and equally spaced from the raised edge guide 64. Once a sheet is justified against the raised edge guide 64 (usually by the upstream most disk 42*a*), the two more downstream disposed disks 42*b–c* simply maintain it forcibly against the raised edge guide 64 as it is motioned downstream into the utilization device 22. The three disks 42*a–c* in this embodiment are each interlinked by drive belts 70 to a central drive motor M. Thus, all disks 42*a–c*** rotate at essentially the same angular velocity.

The sheet justifier 20 according to this invention can be mounted as a free standing portable unit or, as in this embodiment, on brackets 74 that are connected to the utilization device 22. The brackets 74 in this embodiment include adjustment controls 76 for changing the elevation of the upstream funnel 36 relative to access output pods of varying elevations. In this manner, the justifier can accept sheets from a variety of ports on a variety of devices. The port can, in fact, be below the utilization device, on level with the device or above it. The justifier can transfer sheets in any of these orientations.

Figure 10:
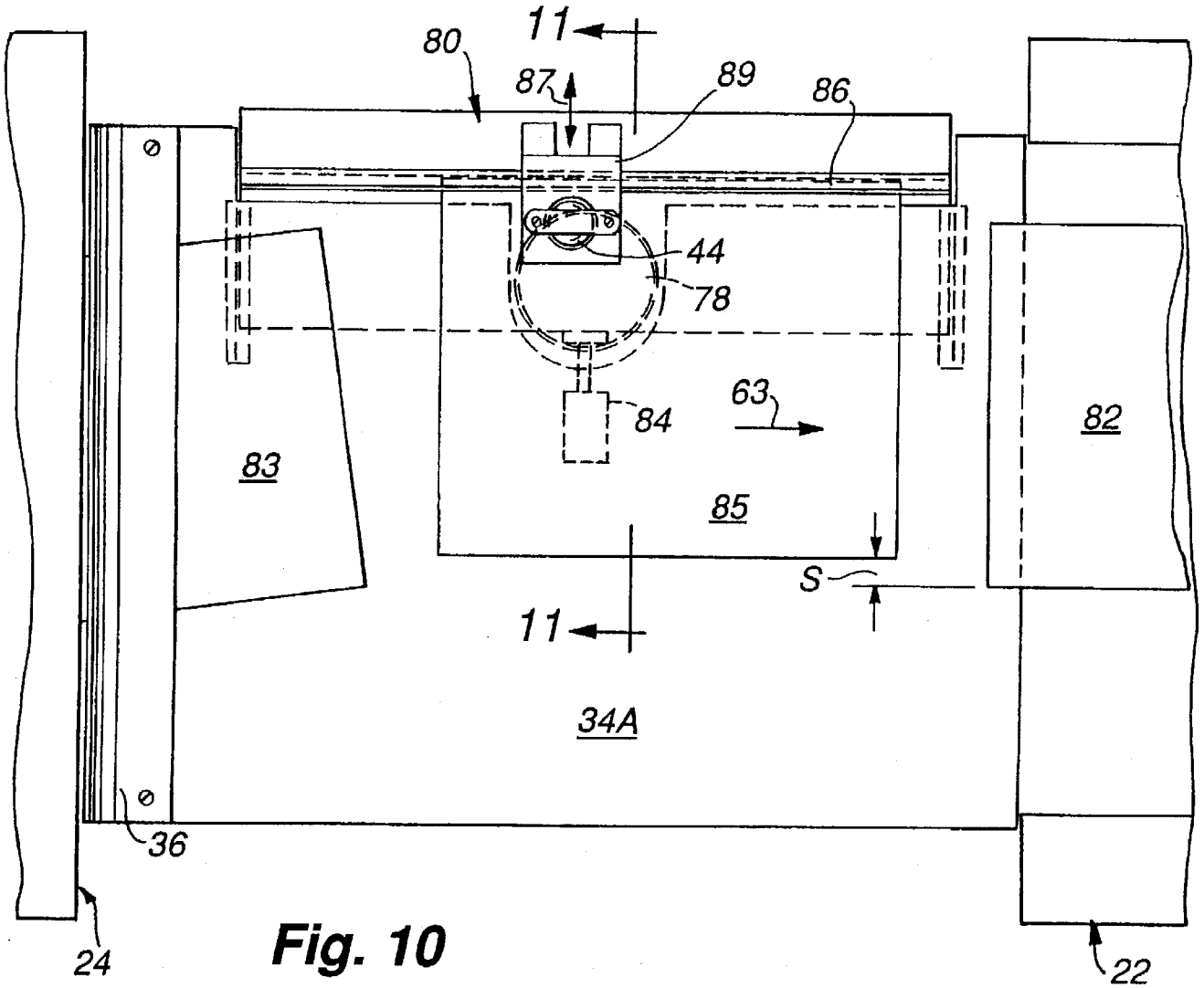
FIG. 10 is an exposed top view of a sheet justifier according to an alternative embodiment of this invention.
Figure 11:
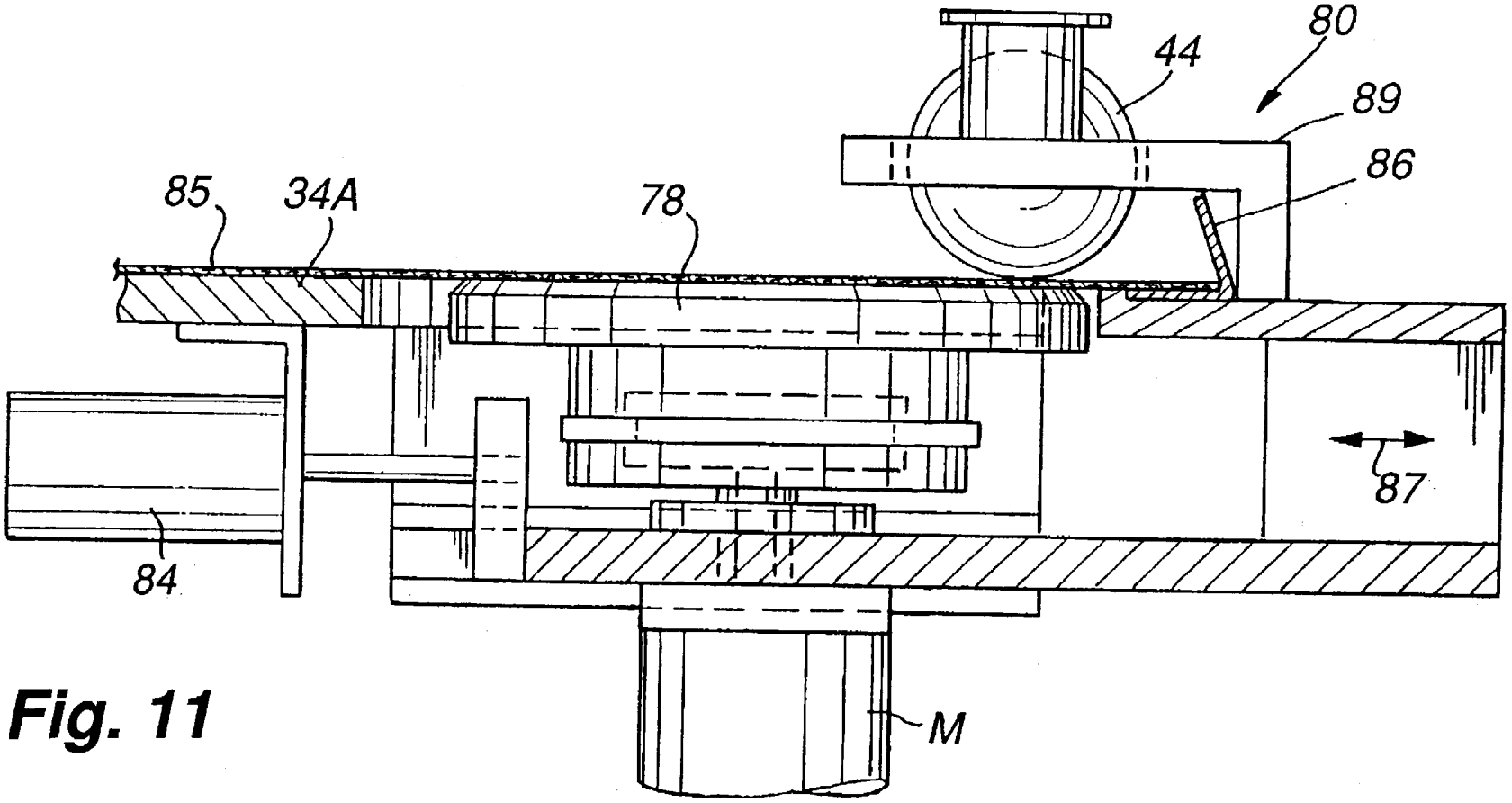
FIG. 11 is a partial rear cross section of the sheet justifier viewed in an upstream direction taken along line 11—11 of FIG. 10.

FIGS. 10 and 11 detail a sheet justifier according to an alternative embodiment of this invention. As noted above, a plurality of rotating disks can be utilized with any embodiment herein. In this embodiment, only one disk 78 has been employed. This embodiment further includes a moving justifier mechanism 80 to produce jog offset sheets (such as downstream sheet 82) at selected times from input unjustified sheets 83. Sheets are normally aligned and justified as shown by sheet 85. In order to offset justified sheets, the mechanism moves transversely to the direction of sheet flow as shown by the arrow 87 for a distance S. Movement can be accomplished by means of a linear actuator 84 as shown, or by a similar mechanism. In this embodiment, the entire justifier mechanism 80, including the disk 85, its motor M, the ball 44 and framework 89 and edge guide 86, moves relative to the table 34A to produce jog offset sheets. Such movement can be advantageous where the spacing between the raised edge guide 86 and the contact point of the ball 44 must be fairly constant. Alternatively, the edge guide 86 can, itself be movable while the disk 78 and weighted ball 44 remain stationary. As long as the spacing between the ball's contact point on the disk and the position of the edge guide remain, at all times, within an acceptable spacing range to prevent sheet buckling, then jog offset sheets can be produced by moving only the raised edge guide 86.

Figure 12:
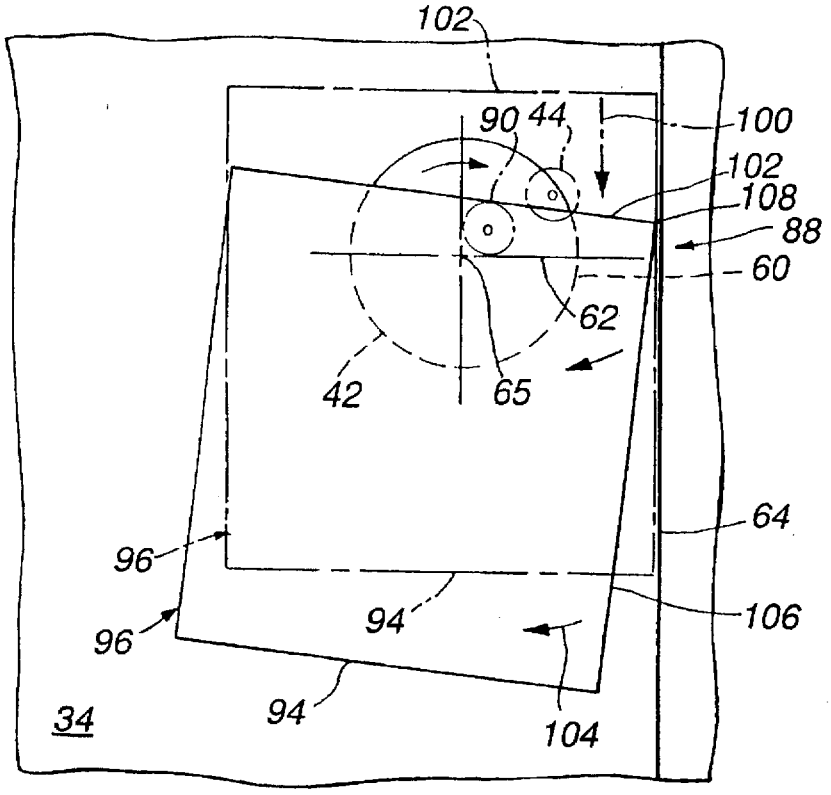
FIGS. 12 and 13 are schematic top views of a sheet justifier according to another alternative embodiment of this invention for enabling rotation of sheets.
Figure 13:
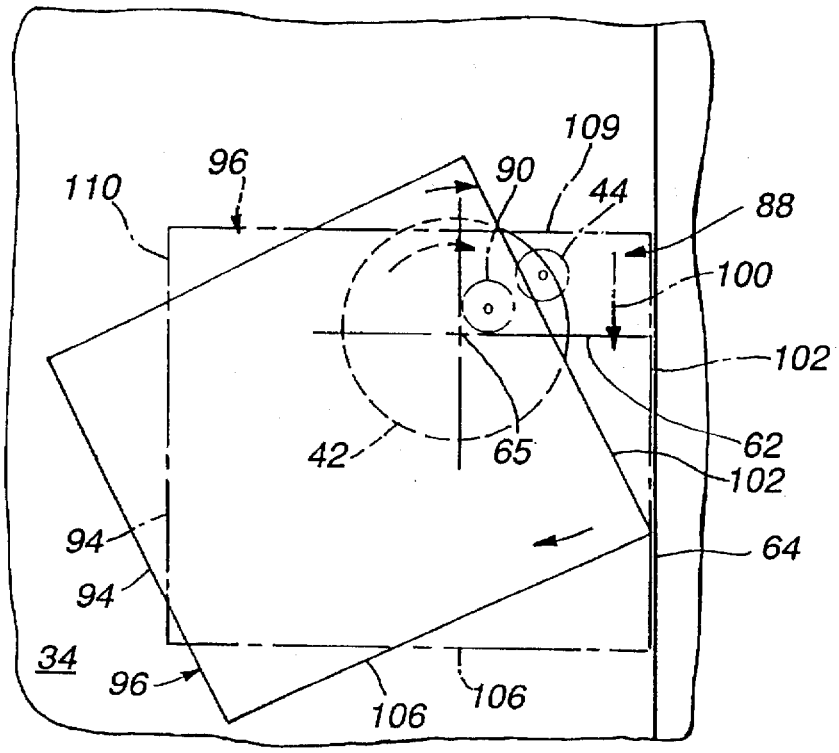

A further improvement according to this invention is depicted in FIGS. 12–13. The sheet justifier mechanism 88 according to this embodiment can be adapted to rotate sheets through 360° and select any sheet edge for justification. The mechanism comprises a disk 42 such as that utilized in the above-described embodiments. There is a first weighted ball 44 positioned proximate the disk outer edge 60 in essentially the same location as that shown in the above-described embodiments (e.g. upstream of the perpendicular diameter line 62). The mechanism 88 according to this embodiment further includes a second weighted ball 90 positioned somewhat closer to the center rotational axis 65 of the disk 42, upstream of the perpendicular diameter line 62, but downstream of the first weighted ball 44. The first more outwardly disposed ball 44 engages the leading edge 94 of the sheet 96 in a manner similar to that of the above-described embodiments. The sheet 96 is justified by the first ball 44 in a relatively normal manner. The sheet 96 is driven as shown by phantom sheet 96 downstream against the edge guide 64 by a downstream vector 100 generated by the first ball 44 until its trailing edge 102 passes out of the first ball's point of contact (solid sheet 96 of FIG. 12). Throughout the driving of the sheet 96, the second more inwardly disposed ball 90 does not substantially affect the driving of the sheet along the raised edge guide 64.

However, once the trailing edge 102 of the sheet passes out of the first ball's contact point, the second ball 90 alone creates a second differently acting set of driving force vectors. The second ball's driving force, owing to its proximity to the rotational axis 65 of the disk 42, is more rotational and less tangential and, hence, causes the downstream part of the sheet's side edge 106 to rotate (arrows 104) about its upstream corner 108 away from contact with the raised edge guide 64. Accordingly, the sheet rotates (solid sheet 96 of FIG. 13) with the second ball 90 so that its (former) trailing edge 102 now engages the raised edge guide 64 as illustrated by the phantom sheet 96 in FIG. 13. The rotated sheet 96 is now brought back into contact with the first more outwardly disposed ball 44. Thus, it is again moved in a downstream direction (arrow 100) along the raised edge guide 64 until the new trailing edge 109 again disengages from the first ball 44. The sheet then again rotates as shown in FIGS. 12 and 13 so that the next edge 110 is brought into contact with the raised edge guide 64. The sheet continues to rotate as long as the second more inwardly disposed ball 90 is in place.

In a practical application, the second ball 90 can include a lifting mechanism, such as a magnet (not shown), that disengages the second ball 90 from contact with the sheet once a desired sheet edge has been brought into contact with the raised edge guide 64. Since the second ball 90 is no longer in contact with the sheet at this time, the sheet is free to travel directly downstream through the justification mechanism into the utilization device without rotating.

Hence, an input sheet can be rotated at selected times by dropping the second more inwardly disposed ball 90 while the sheet is being driven through the mechanism 88. The sheet then rotates through the desired number of edges, until the proper rotation has been achieved. At this time, the ball 90 can be lifted from contact with the sheet to allow the sheet to pass on into the next device with the desired rotational orientation.

Figure 14:
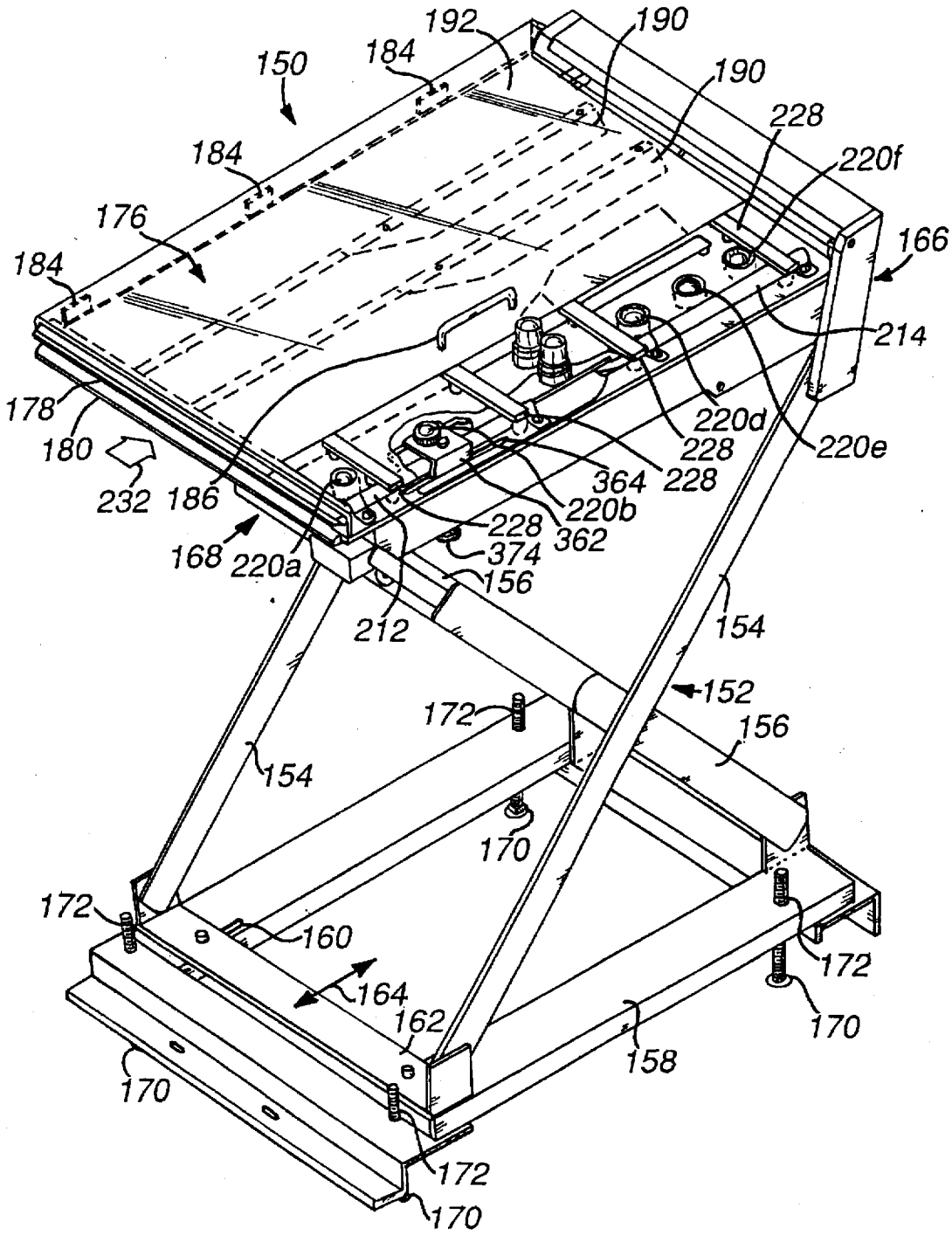
FIG. 14 is a perspective view of a sheet rotator and justifier according to an alternate embodiment of this invention.

A sheet rotator and justifier according to an alternate embodiment of this invention is detailed in FIG. 14. The sheet rotator and justifier 150 of this embodiment includes and integral sheet rotator that, unlike the rotator of FIGS. 12–13, is for use primarily in performing a single 90° rotation as sheets pass through the device. For the purposes of this discussion, the rotator and justifier 150 is referred to as a "rotator." However, this description is meant to include, generally, the justifier elements which are common to both this embodiment and the preceding embodiment of FIG. 1.

The rotator 150 includes a telescoping base structure 152 having crossing supports 154 and 156 that are tied to a base 158. The base 158 includes slots 160 that receive a bracket 162 pivotally interconnected with the crossing supports 154 and 156. The slots 160 enable the bracket 162 to move (double arrow 164 along the base 158 to adjust the height of the output end 166 of the rotator 150. Similar adjustment members can be provided to change the height of the input end 168 so that the rotator 150 of this embodiment can be used with input and output ports of utilization devices having a variety of heights.

The base 158 includes adjustable support pads 170 having threaded extensions 172 that pass through corresponding threaded holes in the base 158. The extensions 172 are elongated so that several inches of height variation can be provided to the base 158 relative to a floor surface. In this manner, overall height of the input and output ports 168 and 166 respectively can be varied.

The rotator, 150 is relatively lightweight and, thus, is easily moveable. However, casters (not shown) can be provided to the base 158 to enhance portability. The casters can be provided at the support pads 170 or can be located elsewhere on the base. The casters can be in continuous contact with the base 158 or can be selectively moveable into engagement with the floor surface when portability is desired. Casters can be provided at each of the four corners of the base 158 or can be provided on one side of the base for movement of the rotator 150 in a tilted orientation in a manner of a dolly.

The rotator 150 includes a flat feeding surface 176 constructed, according to this embodiment, from a polished metal such as steel. The input end 168 of the rotator includes a pair of angled or funnel-like deflectors 178 and 180 that assist in directing sheets from an output port of the utilization device onto the feed surface 176.

In this embodiment, the surface 176 is enclosed by a semi-transparent cover 182. The cover 182 pivots on hinges 184 and is graspable using a top-mounted handle 186. In this embodiment, the cover 182 includes a pair of top-mounted deflectors 190 that can be constructed from a flexible spring material such as metal or lightweight plastic. The deflectors 190 are constructed to bear slightly upon the feeding surface 176 or to stand slightly above the feeding surface 176 in a resting state with the cover 182 closed. The deflectors 190 maintain sheets against the feeding surface 176 to ensure proper movement along the feeding surface 176 and proper entry through the output end 166 of the rotator.

Figure 16:
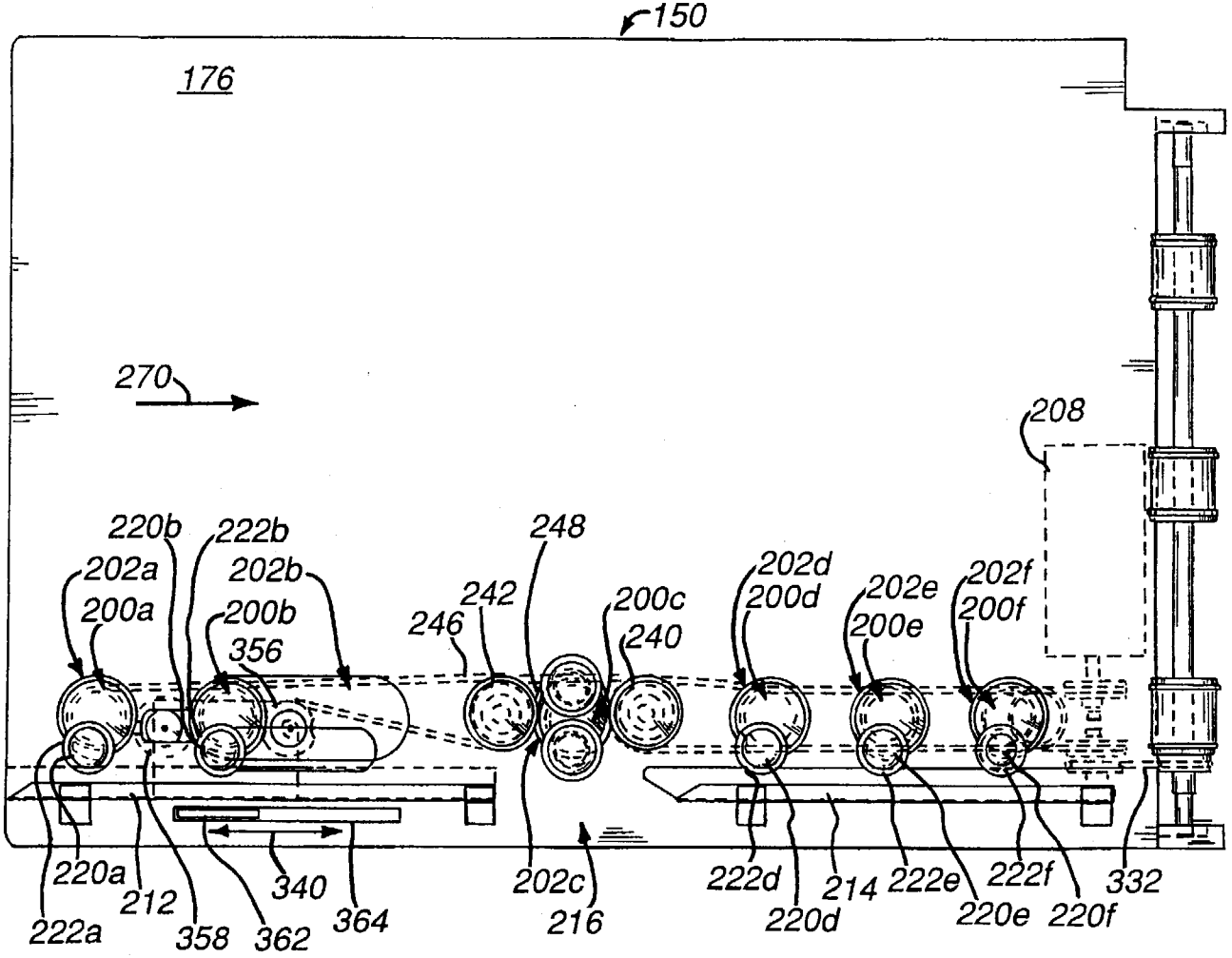
FIG. 16 is a partially-exposed plan view of the sheet rotator and justifier of FIG. 14 with cover removed.
Figure 17:
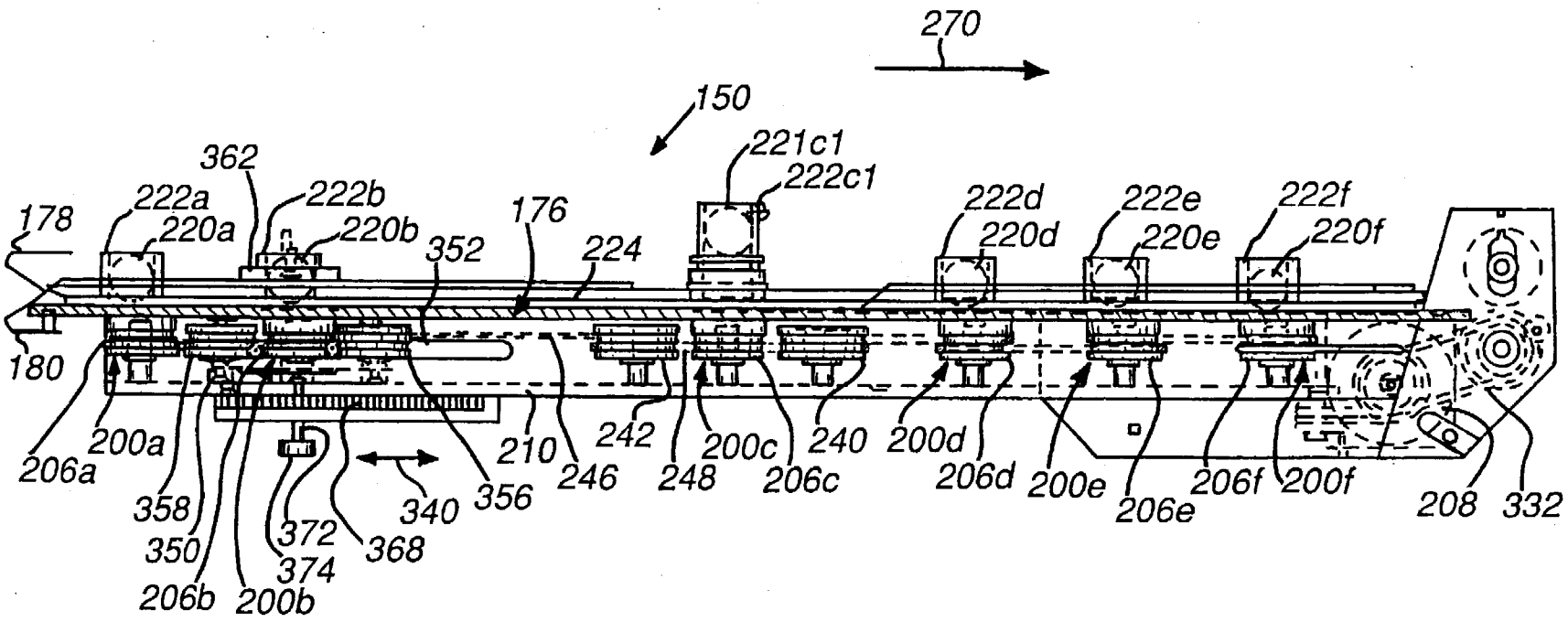
FIG. 17 is an exposed side view of the sheet rotator and justifier FIG. 14.

With further reference to FIGS. 16–17, the rotator, includes the series of rotating disks **200*a*, 200*b*, 200*c*, 200*d*, 200*e*, 200*f*. As described above, each of the disks 200*a*–200*f* are mounted in a corresponding orifice 202*a*–202*f* formed through the feeding surface 176. Each of the disks 200*a*–*f* is similar in structure to rotating disks 42*a*–*c* described above. The number of disks utilized can vary based upon the length of the feeding surface 176. The disks each include a relatively low-friction contact surface 204*a*–204*f* and an integrally-formed pulley 206*a*–206*f* formed on the underside of each disk. The disks can include a gripping friction surface, such as polyurethane or rubber O-ring (see, for example, rings 203 in FIGS. 24–27), adjacent their outer perimeter that resides in a recess on the disk surface 204*a*–*f*. A central drive motor 208 drives the disks 200*a*–200*f* via a series of drive belts that engage respective pulleys 206*a*–206*f* of each of the disks 200*a*–200*f*. Each of the disks 200*a*–200*f* rotates on a central axis that is perpendicular to a plane defined by the feeding surface 176. In this embodiment, each of the disks 200*a*–200*f* is mounted on a bearing plate 210 (FIG. 17) that maintains each of the disks against axial movement, but that enables each disk to rotate about its central axis. In this embodiment, each disk is located so that its respective contact surface 204a–204f is even with or slightly above (for example, up to 1/16 inch above) the plane of the feeding surface 176. The outer perimeter edge of each disk includes a slight chamfer that enables sheets passing onto each disk to slide onto the contact surface 204a–204f of each disk without binding. The disks 200a, 200b, 200d, 200e, and 200f on either side of the central disk 200c are constructed specifically to perform a justification function. An upstream edge guide 212 is provided adjacent the upstream justification disks 200a and 200b. A downstream edge guide 214 is, likewise, provided adjacent the downstream justification disks 200d, 200e and 200f. A gap 216 is present between the upstream edge guide 212 and the downstream edge guide 214. This purpose of this gap 216** is described further below.

Figure 15:
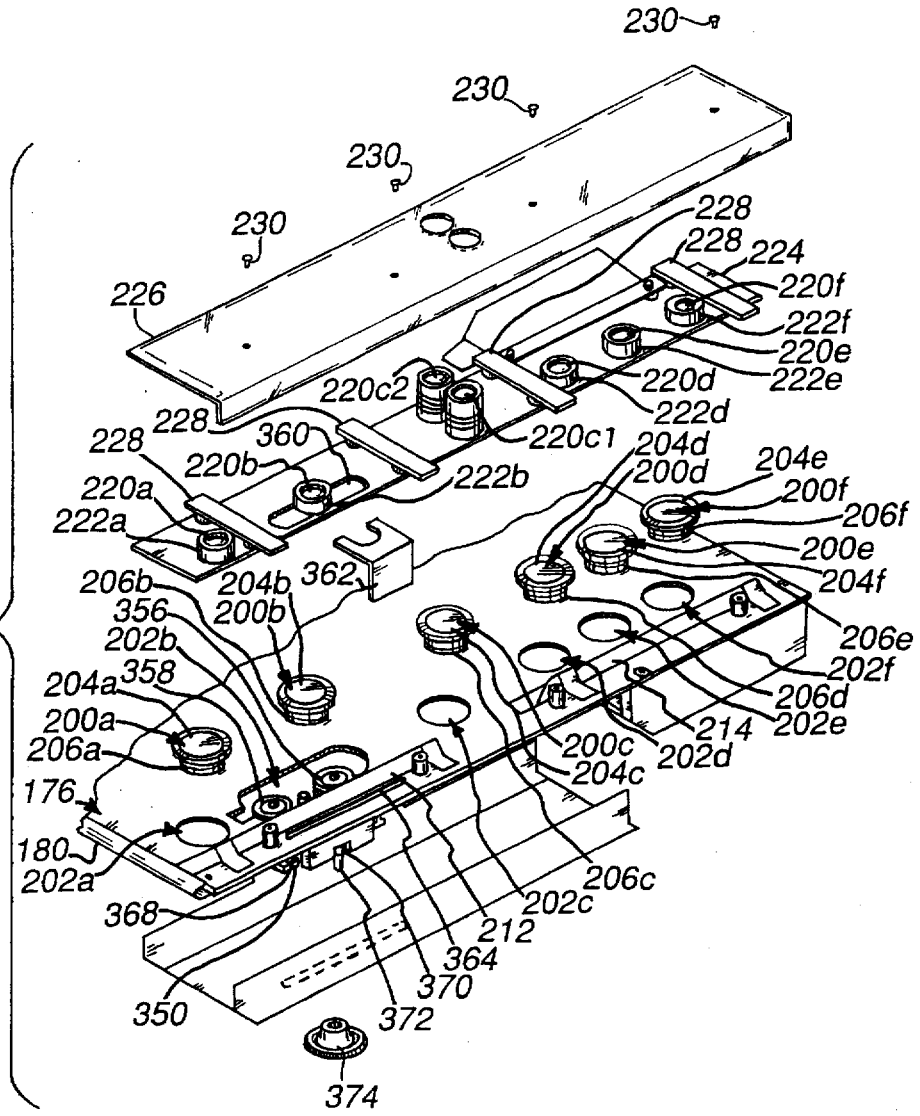
FIG. 15 is a partial exploded perspective view of the sheet rotator and justifier of FIG. 14.

Like the preceding embodiment, the justifier disks 200a, 200b, 200d, 200e and 200f each include an overlying freely rotating mass that, in this embodiment, comprises a ball bearing, 220a, 220b, 220d, 220e and 220f, respectively, that can be ¾" in diameter. The ball bearings of justifier disks 200a, 200b, 200d, 200e and 200f operate in a manner similarly to those described with reference to the embodiment of FIG. 1. Each of the ball bearings 220a, 220b, 220d, 220e, 220f is mounted in a respective retaining member 222a, 222b, 222d, 222e and 222f. Each of the retaining members comprises a cup or cylinder having an inner diameter that is approximately equal to the diameter of each respective ball bearing. A small clearance can be provided between the inner surface of the retaining member 222a, 222b, 222d, 222e, 222f and the respective ball bearing contained therein to prevent binding and to insure that each ball bearing freely rotates in all degrees of freedom. The retaining members can be formed, for example, from a low-friction plastic such as Delrin®. Each of the retaining members 222a, 222b, 222d, 222e and 222f are mounted on a base plate 224 that overlies the feeding surface 276 (FIGS. 15 and 17). In this embodiment, each of the ball bearings 220a, 220b, 220d, 220e and 220f can be prevented from outward movement away from their respective retaining members 222a, 222b, 222d, 222e and 222f by an overlying cover 226 (FIG. 15). The cover 226 can be transparent to reveal the underlying components. The cover is mounted on a series of supporting bars 228 provided on the base plate 224 and secured to the bars 228 by corresponding screws 230.

Each of the retaining members 222a, 222b, 222d, 222e and 222f is mounted so that the contact point of a respective ball bearing contained therein is located upstream of a line taken through the center of rotation of each of the respective disks 200a, 200b, 200d, 200e and 200f, in which the line is perpendicular to the respective edge guide 212 or 214. The respective contact point of each of the balls 220a, 220b, 220d, 220e, and 220f is also located relatively adjacent the respective edge guide 212 or 214 as shown. The balls 200a, 200b, 200d, 200e and 200f can engage the O-ring gripping surface described above if such a surface is utilized. In this embodiment, counterclockwise rotation of each of the disks 200a, 200b, 200d, 200c, 200f causes a sheet passing along the feeding surface 176 in a downstream direction (feed arrow 232 in FIG. 14) to be driven against the edge guide and driven, simultaneously, in the downstream direction by resolved components of force. Positioning of balls and direction of rotation can be changed as long as a downstream component and a justifying component of force (toward the edge guide) are generated.

Figure 16A:
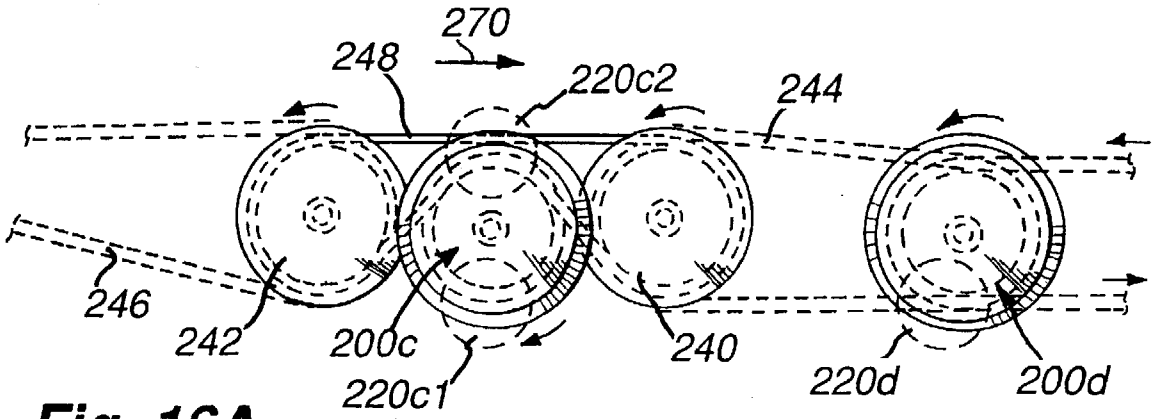
FIG. 16A is a more detailed top view of the rotator assembly of FIG. 16.
Figure 17A:
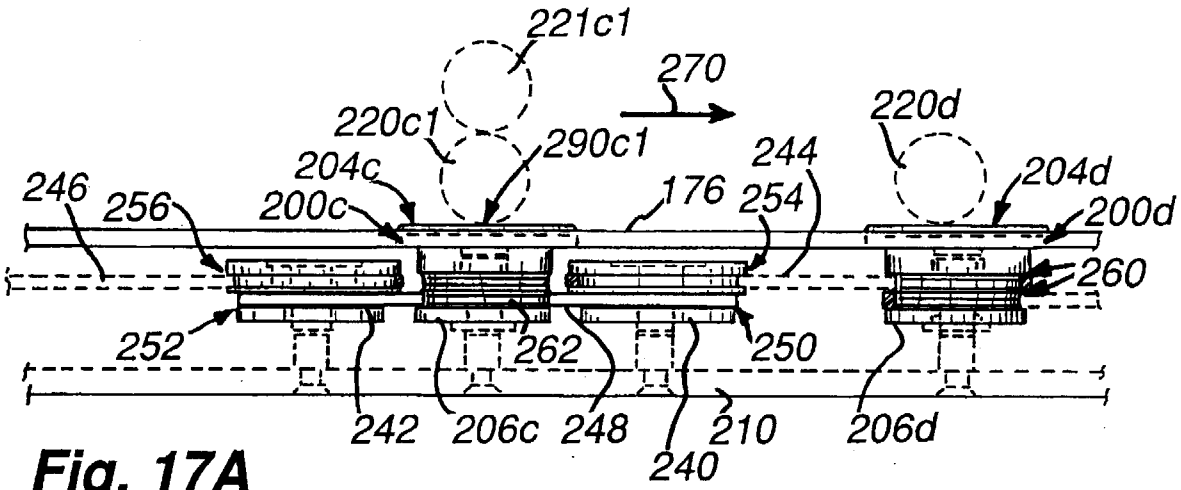
FIG. 17A is a more detailed side view of the rotator assembly of FIG. 17.

The central disk 200c of this embodiment serves the rotator according to this invention. With further reference to FIGS. 16A and 17A, the central disk 200c comprises a rotator according to this invention. The rotator disk 200c is similar in size and shape to the other disks used herein. Unlike the justifier disks 200a, 200b, 200d, 200e and 200f, the rotator disk 200c rotates in a clockwise direction. This opposing rotation is generated using a pair of idler pulleys 240 and 242 rotated on the downstream and upstream sides, respectively, of the rotator disks 200c. The downstream idler pulley 240 is interconnected with a drive belt 244 that extends from the adjacent downstream justifier disk 200d. The upstream idler pulley 242 is connected with an upstream-extending belt 246 that engages the two upstream justifier disks 200a and 200b. This belt is described further below. Each of the belts shown and described herein can comprise a continuous polyurethane belt having a circular cross section. However, other types of belts can be substituted.

As shown, each of the disks includes a pair of axially-spaced sheaves for accommodating two belts. Typically, a driving belt and a driven belt. Between the idler pulleys 240 and 242 is disposed a connecting belt 248. The connecting belt 248 is positioned around the lower sheave 250 and 252 of each of the idler pulleys 240 and 242, respectively. Note that each lower sheave 250 and 252 is smaller in diameter than a respective upper sheave 254 and 256 on each idler pulley 240 and 242. Similarly, the upper sheaves 254 and 256 are larger in diameter than the sheaves 260 on the adjacent downstream driving disk 200d. Hence, the connecting belt 248 moves slower than the adjacent downstream belt 244 and upstream belt 246. The rotator disk 200c, thus, rotates slower by between 10 percent and 30 percent, for example, than the adjacent justifying disks. Since the idler pulleys 240 and 242 have sheaves 250, 254, 252, 256, respectively, that are equal to each other in size, the upstream driving belt 246, moves at a rate similar to the downstream driving belt 244. Hence, only connecting belt 248 moves at a slower speed. The slower-moving connecting belt 248 is wrapped around an opposing side (reverse wrap) the lower sheave 262 of the rotating disk 200c. The rotating disk 200c, thus, moves slower relative to the adjacent justifying disks 200a, 200b, 200d, 200e and 200f. The belt 248 is wrapped around an opposing side of the sheave 262 to form a partial, approximately 30 degree wrap around the disk sheave 262 that causes the disks to rotate clockwise, oppose the justifying disks.

The rotator disk 200c is overlied by a pair of balls 220c1 and 220c2 that are aligned perpendicularly to the downstream direction (arrow 270). The balls 220c1 and 220c2 are aligned with their centers on a line that passes approximately through the center of rotation of the rotator disk 200c. The line is actually slightly upstream of the (approximately 0.031 inch) of the axis of rotation of the disk 200c. As described further below, this offset enables the balls 220c1 and 220c2 to each exert a slight justifying moment on sheets passing therethrough in a direction toward the edge guide 212.

Figure 18:
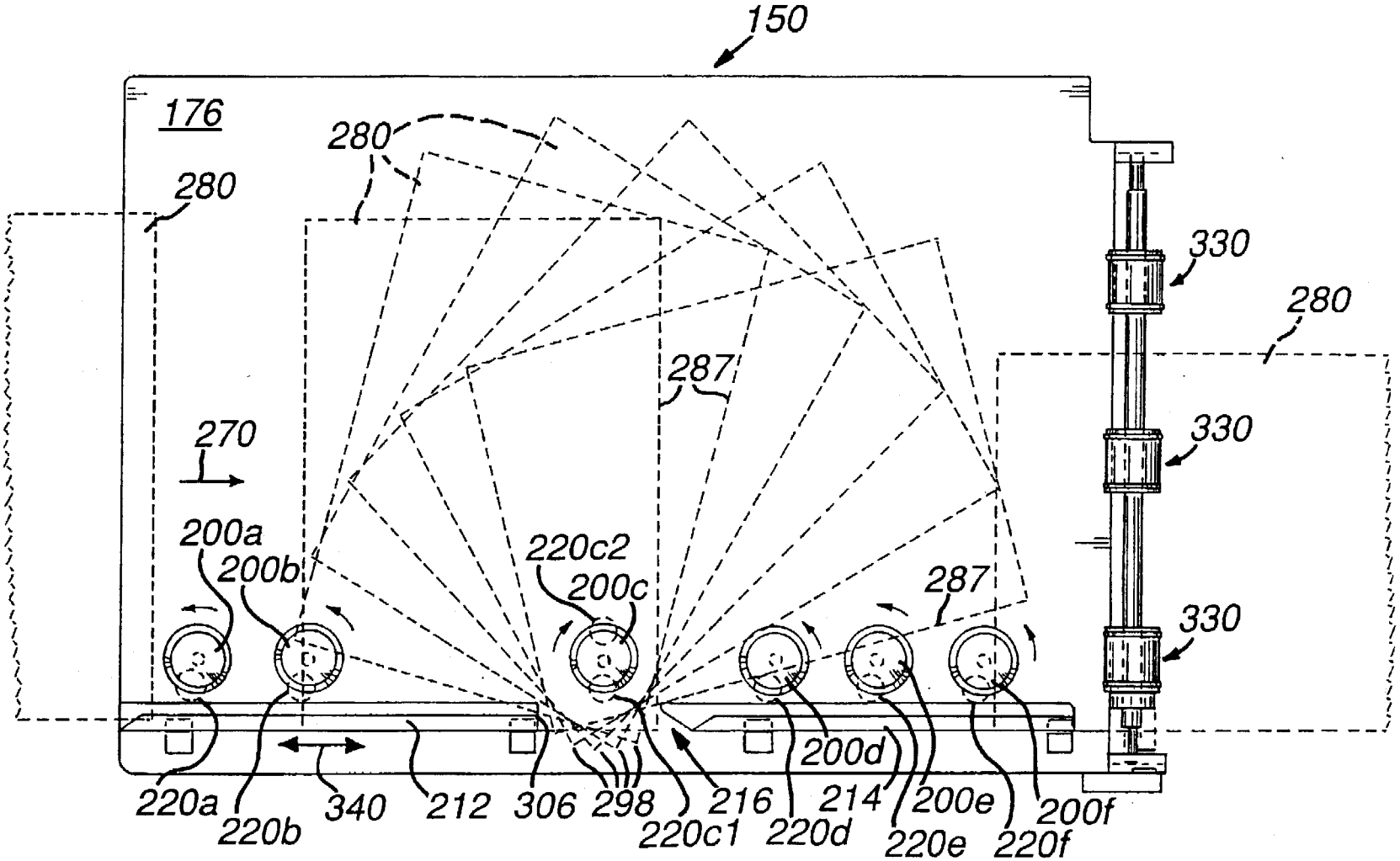
FIG. 18 is a somewhat schematic top view of the sheet rotator and justifier of FIG. 14 illustrating the rotation of a sheet according to this invention.

With further reference to FIGS. 18–22, a sheet rotation process according to this invention is illustrated. FIG. 18 shows the rotation of a sheet 280 (in phantom) through successive stages. The sequence is shown in more detailed frames in FIGS. 19–22.

Figure 19:
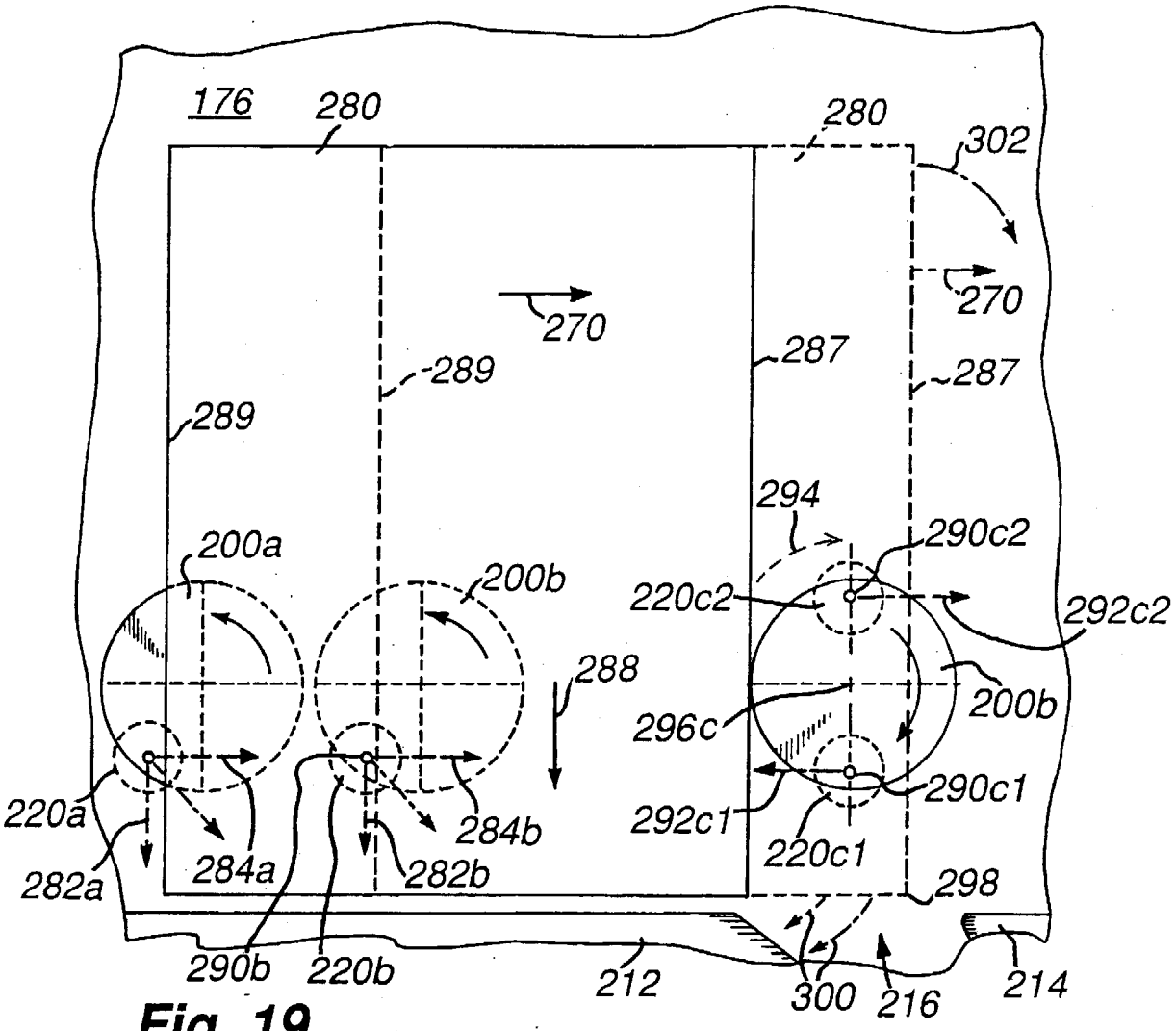
FIGS. 19–22 are schematic plan views of the sheet rotation process according to this embodiment.
Figure 20:
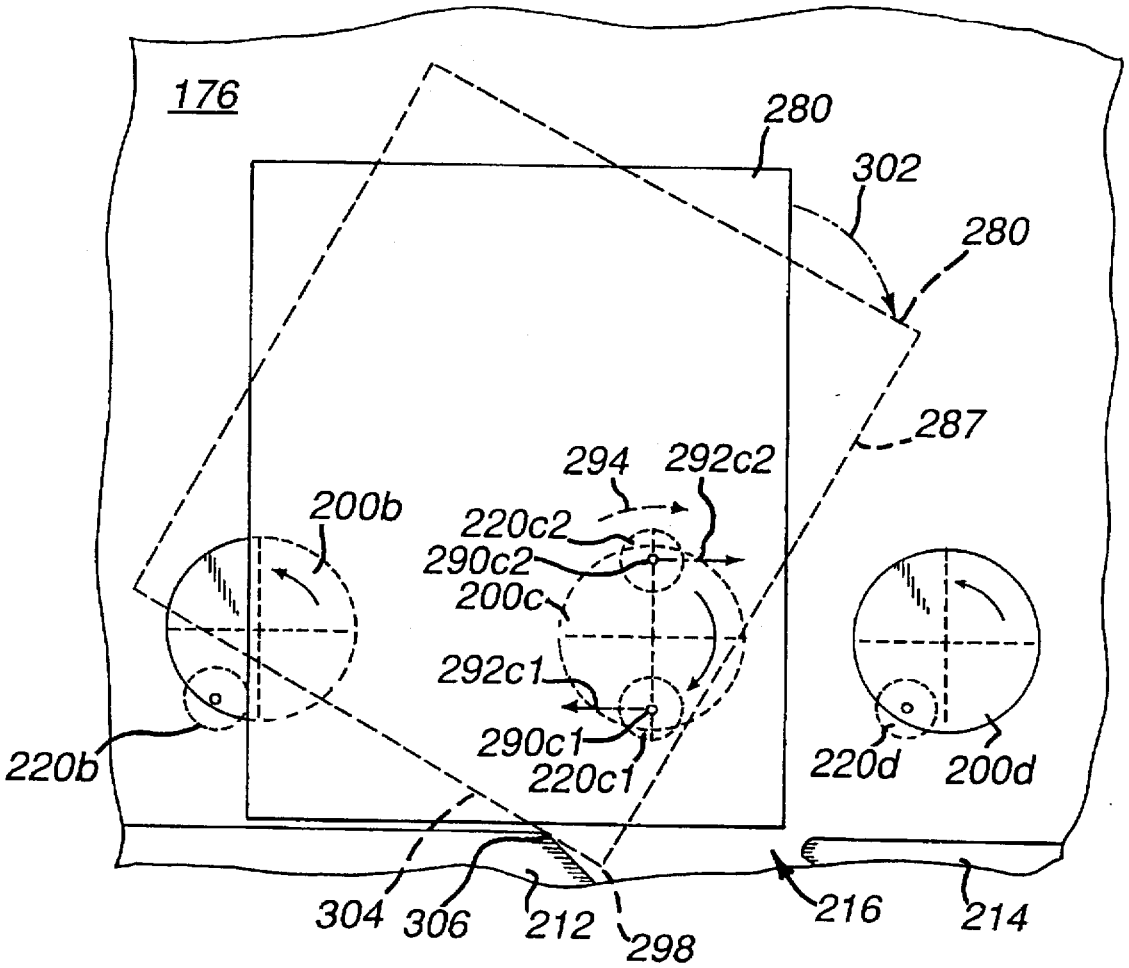

As detailed in FIG. 19, a sheet 280 is transferred downstream (arrow 270) from the first and second justifier disks 200a and 200b to a position (shown in phantom) that is an engagement with the rotator disk 200c. During the transfer process, the balls 220a and 220b generate, at their contact points with respective disks 200a and 200b, perpendicular force components 282*a*, 284*a*, 282*b*, and 284*b* downstream-directed components 284*a* and 284*b* cause the sheet 280 to move in the downstream direction (arrow 270) and perpendicularly-directed component 282*a* and 282*b* drives the sheet into engagement (arrow 288) with the edge guide 212. The front edge 287 of the sheet 280 passes through the contact points 290*c*1 and 290*c*2 of each of the balls 220*c*1 and 220*c*2, respectively, after the rear edge 289 passes beyond the contact point 290*b* of justifier ball 220*b*. Thus, the sheet 280 is no longer driven against the edge guide by the justifier disk 200*b*. Accordingly, the sheet 280 is fully under the control of the rotator disk 200*c* which generates a pair of oppositely-directed-components of force 292*c* 1 and 292*c*2 that are approximately parallel to the downstream direction and that, in combination, generate a rotational moment (curved arrow 294*c*) that is approximately centered about the rotational axis 296*c* of the disk 200*c*. The rotational moment 294 acts adjacent the forward edge 287 of the sheet to drive the corner 298 into the gap 216 between the upstream edge guide 212 and the downstream edge guide 214 in the approximate direction of the arrows 300. As further detailed in FIG. 20, the corner 298 is driven into the gap 216 as the edge 304 of the sheet 280 that is adjacent the edge guide engages an opposing corner 306 of the upstream edge guide, thus forming a fulcrum that causes the forward edge 287 to rotate (curved arrow 302) in the direction toward the downstream edge guide 214.

Figure 21:
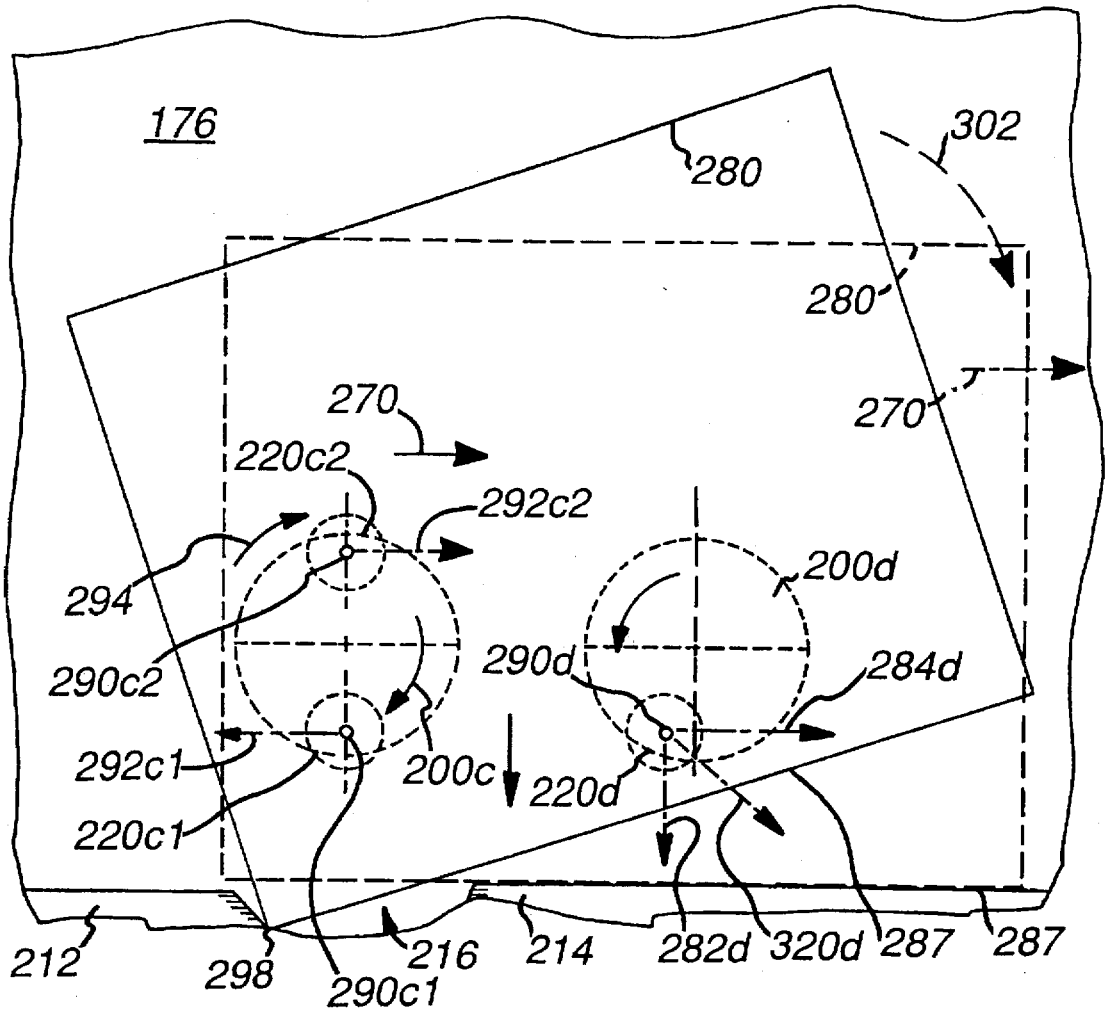
Figure 22:
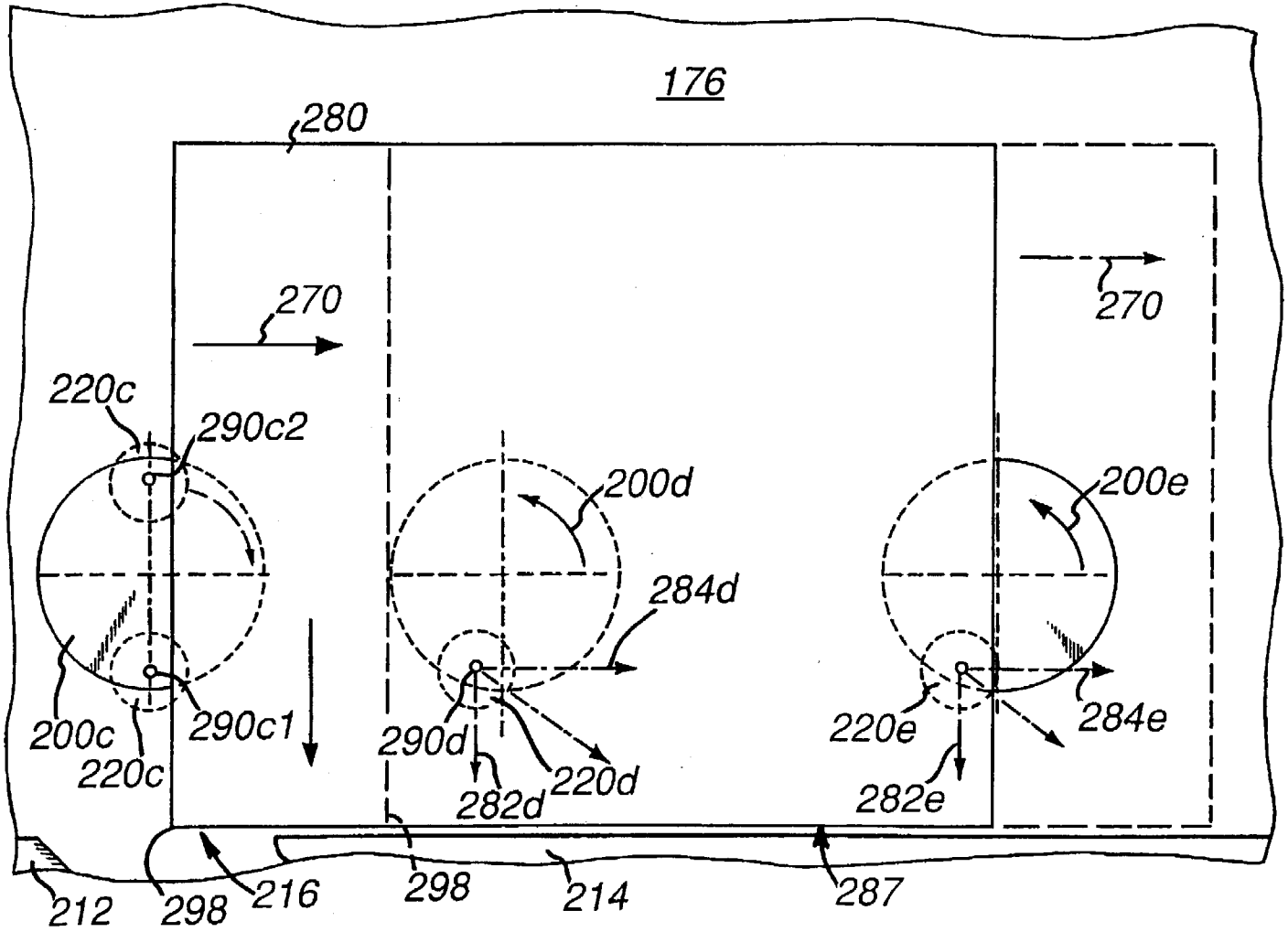

As shown in FIG. 21, the sheet 280 has been rotated (curved arrow 302) into engagement with the contact point 290*d* of the justifier ball 220*d* and justifier disk 200*d*. The disk 200*d* generates, at the contact point 290*d* a force vector 320*d* that is resolved into a perpendicular component 282*d* and a downstream component 284*d*. The freely-rotating property of the balls 220*d*, 220*e* and 220*f* enable the sheet to enter the disks in an approximately perpendicular motion, relative to the downstream direction. The force vector 320*d*, thus, begins driving the sheet perpendicularly fully against the downstream edge guide 214 (as shown in phantom) and, simultaneously, begins driving the sheet in the downstream direction away from the rotator disk 200*c*. Since most of the, formerly, front edge 287 of the sheet engages the downstream edge guide 214, the sheet cannot rotate beyond the portrait configuration (shown in phantom) in which the edge 287 is in engagement with the edge guide 214. Thus, the sheet slips relative to the rotator contact points 290*c*1 and 290*c*2 once it has engaged the edge guide 214. The downstream justifier disk 200*d* rapidly drives the sheet away from the rotator disk 200*c* in a downstream direction (arrow 270) as shown in FIG. 22. The downstream justifier disks 200*d* and 200*e* subsequently engage the sheet 280 and exert resolved components of force 282*d*, 284*d*, 282*e* and 284*e* on the sheet to maintain it in a justified position against the downstream edge guide 214 as it is driven in a downstream direction (arrow 270).

With reference to FIGS. 16–18, the justified sheet exits the feeding surface 176 via a set of driven output rollers 330 that are interconnected with the central drive motor 208 by an associated belt 332. As shown in FIG. 18, the rollers 330 are spaced apart from each other so that at least two sets of rollers 330 engages sheet in the narrower portrait configuration for even output of the sheet 280 in a justified orientation.

As noted above, the rotator balls 220*c*1 and 220*c*2 are positioned with centers aligned along a line that is located slightly upstream of a center of rotation of the rotator disk 200*c*. This positioning induces a slight component of force in the direction of the edge guides (perpendicular to the downstream direction). This component assists in maintaining the corner 298 of the sheet against the edge guide 212 as the sheet is rotated, thus ensuring that the upstream edge guide 212 acts as a fulcrum about which the sheet pivots.

Note that the downstream justifier disk 200*d* is positioned so that it receives the edge 287 of the sheet as it is rotated. The disks 200*e* and 200*f* are generally positioned so that they also receive the edge 287 of a conventional-sized sheet. To properly feed sheets, the most-adjacent downstream disk 200*d* should be spaced from the rotator disk so that a portion of the narrowest sheet to be rotated will engage the disk 200*d* and ball 200*d* when rotated by the rotating disk 200*c*.

Since the rotator requires extra force to drive the sheet around, the ball holders 221*c*1 and 222*c*2 are approximately twice as long as the justifier ball holders 222*a*, 222*b*, 222*d*, 222*e* and 222*f*. These ball holders 222*c*1 and 222*c*2 are constructed to accommodate a second (upper) set of balls 221*c*1 and 221*c*2. These upper balls 221*c*1 and 221*c*2 are essentially identical to the lower, engaging, balls 220*c*1 and 220*c*2. The upper balls 221*c*1 and 221*c*2 provide extra weight that acts at the respective contact points 290*c*1 and 290*c*2 to ensure positive rotational driving of sheets by the rotator disk 200*c*. The balls freely rotate in all degrees of freedom to ensure that the engaging balls 220*c*1 and 220*c*2 also freely rotate.

It should be clear from this description that the rotator assembly according to this embodiment can be used with a variety of sizes and shapes of sheets. While the illustrated example depicts a sheet being rotated from a landscape orientation to a portrait orientation, it is contemplated that sheets can be, conversely, rotated from a portrait orientation to a landscape orientation. Likewise, approximately square sheets can be rotated. As noted above, the adjacent downstream justifier disk 200*d* is located to receive the narrowest width sheet contemplated. The upstream adjacent disk 200*b*, conversely, is adjustable based upon the input length (in a downstream direction) of sheets. The adjustability is depicted by double arrow 340 indicating that the adjacent upstream disk 200*b* and its associated ball 220*b* are moveable within a predetermined range in each of an upstream and downstream direction relative to the rotator disk 200*c*.

Figure 23:
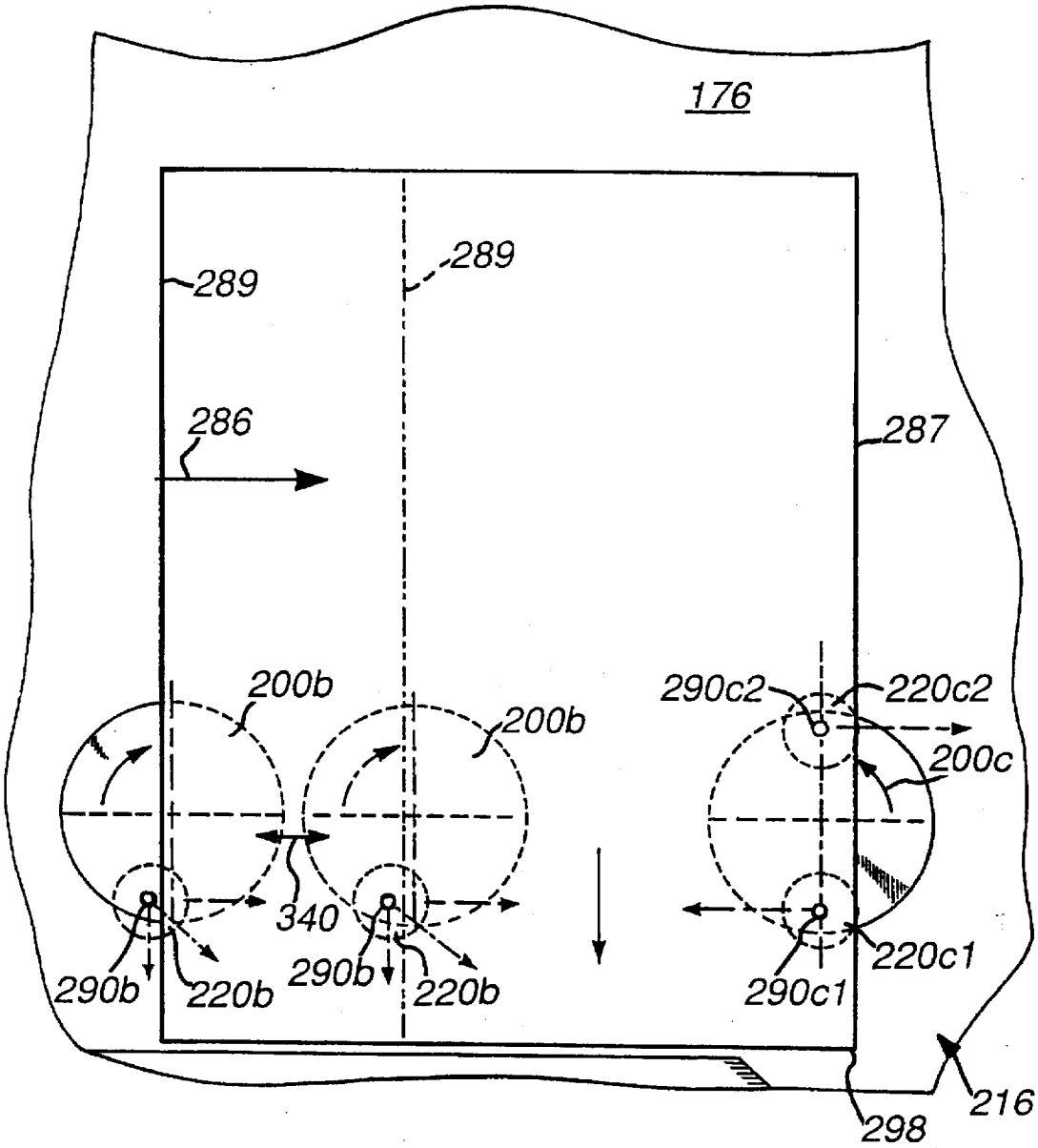
FIG. 23 is a schematic plan view of the operation of the adjustable disk with differing size sheets.

With reference to FIG. 23, the disk 200*b* is shown in each of an upstream most position and (in phantom) in a downstream most position. The location of the upstream most position and downstream most position can be based entirely upon the input length of the longest and shortest sheets to be utilized. As described above, the sheet's rear edge 289 should typically pass out of engagement with the upstream justifier's contact point 290*b* directly subsequent entry of the front edge 287 of the sheet through the rotator contact points 290*c*1 and 290*c*2. Otherwise, the justifier disk 200*b* would resist rotation of the sheet by the rotator disk and, more importantly, the sheets corner 298 would not be properly located within the gap 216 at the time of rotation since the justifier disk 200*b* will continue to drive the corner 298 past the appropriate location in the gap 216. Accordingly, the justifier disk 200*b*, and its associated ball 220*b*, can be moved (double arrow 340) to the proper setting for a given input length of sheet.

With reference to FIGS. 14–17, movement of the disk 200*b* and ball 220*b* is facilitated by an elongated orifice 202*b* (FIG. 15) within the feeding surface 176. The orifice enables the disk 200*b* to be relocated in an upstream-to-downstream direction relative to the rotator disk 200*c*. The disk 200*b* is mounted on a separate supporting base 350 that slides within a horizontal slot 352 (FIG. 17) formed in the side of the rotator's frame. A pair of idler rollers 356 and 358 are located adjacent the movable justifier disk 200*b* on the upstream and downstream sides of the disk 200*b*. The disks 356 and 358 receive the drive belt 246 and cause the drive belt 346 to wrap around a portion of the adjustable disk 200*b* (see FIG. 16). Since the belt 246 is only partially wrapped around each of the idler rollers 356 and 358 and is, also, only partially wrapped around the disk 200*b*, the rollers 356, 358 in disk 200*b* can move in an upstream and downstream direction without need to change the size of the belt. As the disk 200*b* and rollers 356 and 358 move upstream or downstream, they roll along a portion of the belt 246 while the belt 246 maintains its current position. Such adjustment movement, in fact, can occur while the belt 246 is being driven by the motor 208.

The ball holder 222*b* for the adjustable disk 200*b* is mounted within a slot 360 (FIGS. 15) within the ball holder base plate 224. Support for the ball holder 220*b* is provided by an overhanging bracket 362 that moves within a slot 364 within the frame of the rotator 150. The bracket 362 is interconnected with the moving base assembly 350 and, thus, moves in conjunction with movement of the base assembly 350. Hence, the contact point 290*b* of the ball 220*b* with the disk 200*b* remains constant throughout the entire range of upstream-to-downstream movement. According to this embodiment, a gear rack 368 is positioned on the underside of the rotator frame. The gear rack engages a pinion gear 370 mounted on a shaft 372 that projects beneath the underside of the rotator frame. The shaft is rotated by rotating an adjustment knob 374 located on the underside. The adjustment knob 374 can be provided with a locking structure that maintains the base 350 at a predetermined location once adjustment has been accomplished. According to this invention an indicia (not shown) can be provided (for example) adjacent the slot 364 and the bracket 362 so that the user can align the disk 200*b* relative to a predetermined sheet length. In other words, the indicia can be provided with numbers representative of predetermined sheet lengths, and by moving the mechanism so that it is aligned relative to a given value, the disk 200*b* is preset to feed the predetermined length of sheets.

With reference to FIGS. 24–27, it is contemplated that only one rotator ball 220*c*1 or 220*c*2 need be placed in contact with input sheets 280 to facilitate rotation Additionally, it may be desirable to deactivate rotation at given times wherein both rotator balls 200*c*1 and 220*c*2 are disengaged from the rotator disk 200*c*. As noted, one possible method of deactivating rotation involves applying a magnetic force to lift the metallic balls 220*c*1 and 220*c*2 out of engagement with the rotator disk 200*c*. In one embodiment, it may be desirable to apply only one ball 220*c*1 or 220*c*2 for a given size, shape, and/or thickness of sheet. For example, lightweight and smaller sheets may be damaged by use of two rotator balls 220*c*1 and 220*c*2 and the resulting force generated by contact of both balls 220*c*1 and 220*c*2.

Figure 24:
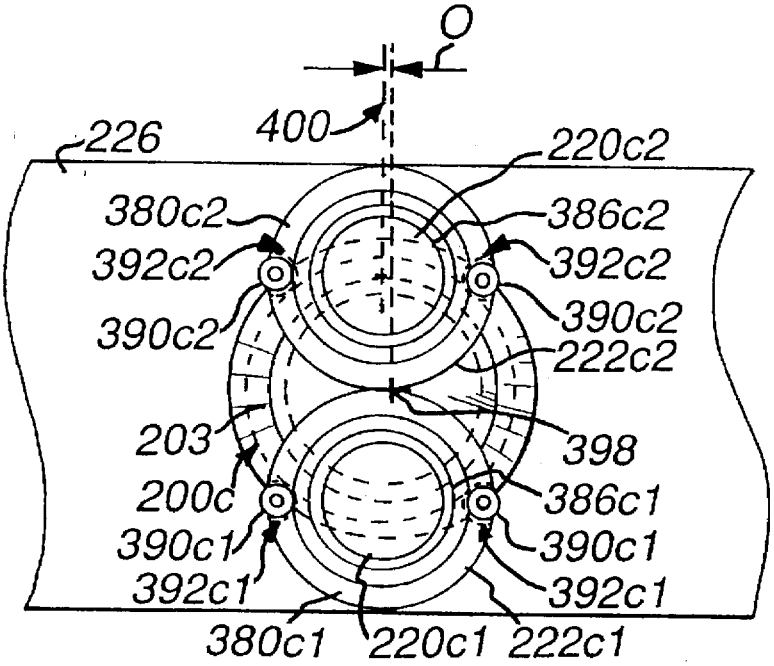
FIGS. 24 and 25 are respective plan and side views of the sheet rotating mechanism in a fully-engaged position.
Figure 25:
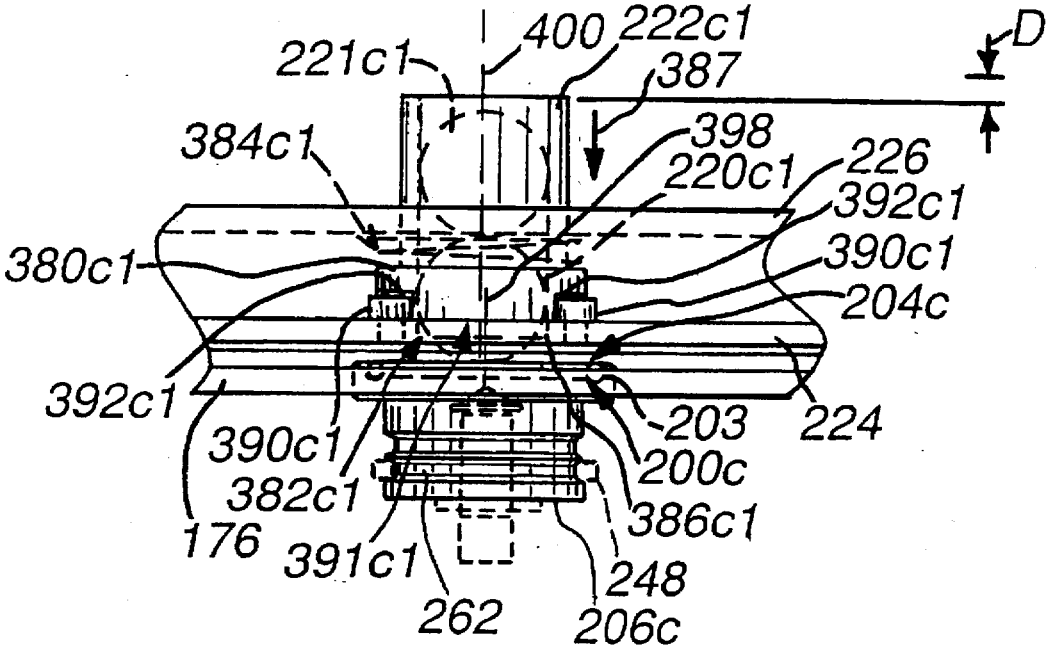
Figure 26:
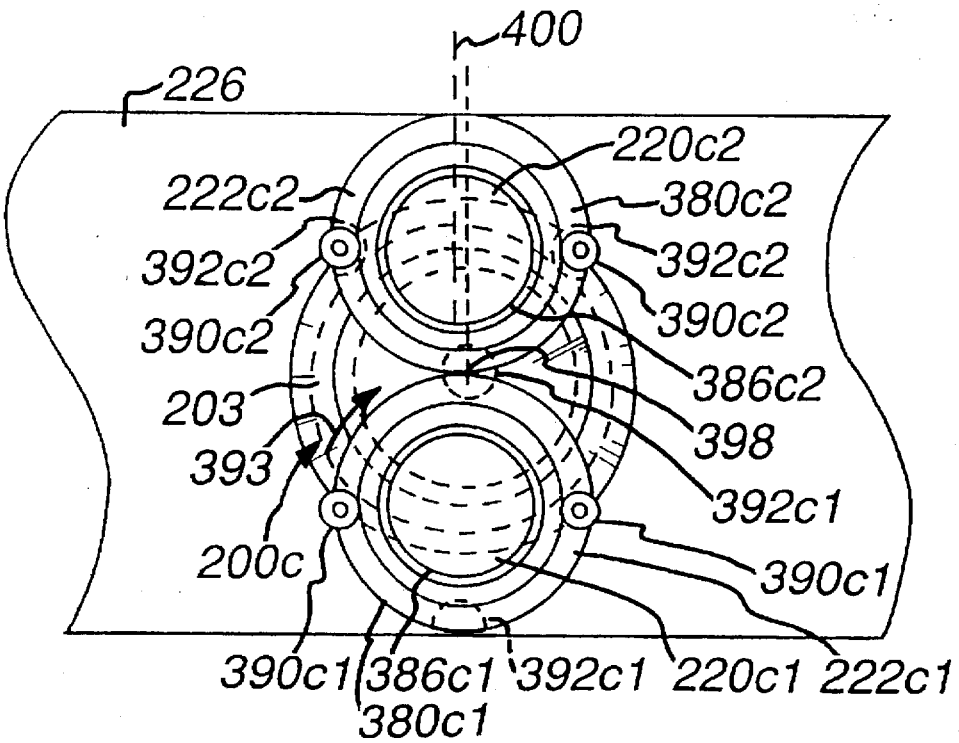
FIGS. 26 and 27 are respective plan and side views of the sheet rotating mechanism in a partially-disengaged position.
Figure 27:
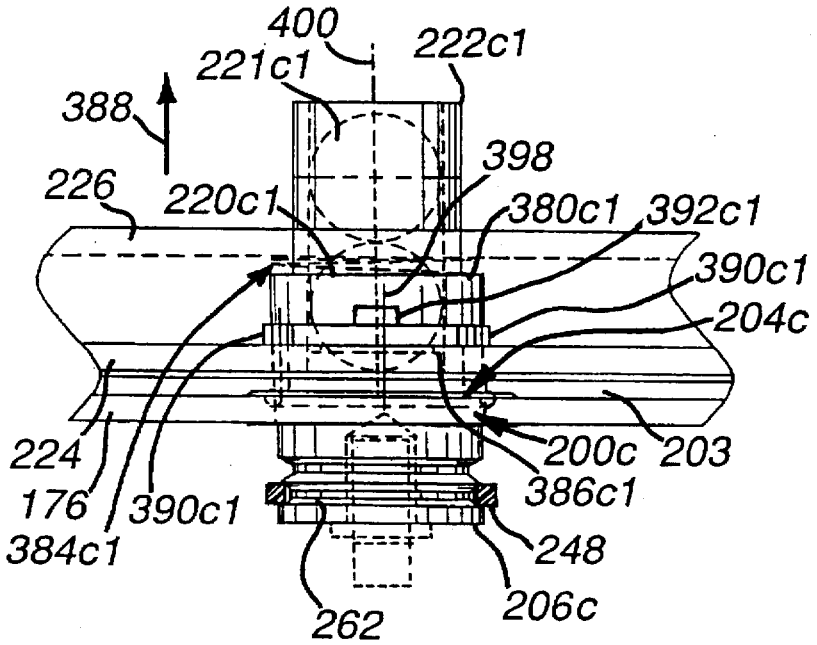

Accordingly, FIGS. 25–27 illustrate adjustable ball holders 222*c*1 and 222*c*2 for use with respective balls 220*c*1, 221*c*1, 220*c*2 and 221*c*2. The ball pairs 220*c*1, 221*c*1 and 220*c*2, 221*c*2 are each contained within respective holders 222*c*1 and 222*c*2. Each holder can be selectively engaged and disengaged from the surface 204*c* of the rotator disk 200*c*. As detailed in FIGS. 24 and 25, both sets of balls 220*c*1 , 221*c*1 and 220*c*2, 221*c*2 are positioned so that the engaging balls 221*c*1 and 220*c*2 rest upon the surface of the disk 200*c* and, thereby, generate a pair of corresponding rotating tangentially-directed, force vectors as described above. The retaining members 222*c*1 and 222*c*2 are located through respective orifices in the coverplate 226. The retaining members 222*c*1 and 222*c*2 each include a larger diameter stop ring 380*c*1 and 380*c*2, respectively, that rests upon the lower base plate 224 (382*c*1 is shown in FIG. 25) through which at least a portion of the engaging balls 220*c*1 and 220*c*2, respectively, can pass. The holes in the base plate 224 is not large enough to allow the respective stop rings 380*c*1 and 380*c*2 to pass. Thus, each stop ring rests upon the edge of the hole.

A corresponding spring (384*c*1 is shown in FIG. 25) bears upon each respective the stop ring 380*c*1 and 380*c*2 and drives the stop ring downwardly away from the cover plate 226 and into engagement with the base plate 224. Each spring can comprise a conventional coil spring having a sufficient compressive force to enable manual movement of each retaining member 222*c*1 222*c*2 toward the cover plate 226 and away from the base plate 224, but sufficient compression to enable each stop ring to remain in engagement with the base plate 224.

Each stop ring 380*c*1 and 380*c*2 includes a respective shoulder 386*c*1 and 386*c*2, at the lowermost end adjacent the respective engaging ball 220*c*1 and 220*c*2. The shoulder is sized in diameter to allow the ball to freely contact the surface 204*c* of the disk 200*c* when each respective stop ring 380*c*1 and 380*c*2 engages the base plate 224 in a fully-downward (arrow 387 in FIG. 25) orientation.

As further detailed in FIGS. 26 and 27, the retaining member 222*c*1 has been lifted upwardly (arrow 388 in FIG. 27) toward the cover plate 226. The lip 386*c*1 is sized to prevent the engaging ball 220*c*1 from dropping fully out of the retaining member 222*c*1. Thus, upward movement (arrow 388 in FIG. 27) of the retaining members 222*c*1 and 222*c*2 causes each corresponding ball to bear against the lip 386*c*1 and be lifted away from the surface 204*c* of the disk 200*c*.

A pair of set screws 390*c*1 and 390*c*2 are provided on the base plate 224 adjacent. The set screws 390*c*1 and 390*c*2 have a head height of approximately 5/32 inch. This height translates into a generated displacement D that is sufficient to support the engaging balls 220*c*1 and 220*c*2 away from the surface 204*c* of the disk 200*c*. As shown in FIGS. 24 and 25, the stop ring 380*c*1 fully engages the base plate 224 as the screws 390*c*1 are disposed within conforming recesses 392*c*1 and 392*c*2 formed in the underside (391*c*1 is shown in FIGS. 25 and 27) of the stop ring 380*c*1 and 380*c*2.

As shown in FIGS. 26 and 27, by rotating the retaining member 222*c*1 (curved arrow 393 in FIG. 26) and its associated stop ring 380*c*1 so that the recesses 392*c*1 are out of alignment with the screws 390*c*1, the unrecessed portion of the underside of the stop ring 380*c*1 bears upon the tops of the screws 390*c*1 at a displacement D from the base plate 224. As such, the ball 220*c*1 is placed out of contact with the surface 204*c* of the disk 200*c*. In FIG. 26, the rotation of the retaining member 222*c*1 is a full 90° relative to the alignment of the screws 390*c*1. However, even a small rotation is sufficient to cause the stop ring 380*c*1 (or 380*c*2) to be placed in a retracted position in which the balls are disengaged from the disk.

Retraction of the balls according to this embodiment involves the initial lifting (arrow 388) of the retaining member 222*c*1 or 222*c*2 by grasping the exposed portion of the retaining member located outwardly of the cover plate 226*c*. The spring force is overcome by the lifting until the retaining member 222*c*1 or 222*c*2 is raised to a position that is greater than or equal to the height of the cap screws 390*c*1 or 390c2. The retaining member 222c1 or 222c2 is then rotated until the recesses 392c1 or 392c2 are placed out of alignment with their respective screws. Reengagement of a given set of balls 220c1 or 220c2 proceeds in the opposite order. It should be clear that the described method and structure provides a quick, easily constructed and effective mechanism for engaging and disengaging one or both of the rotator balls 220c1 and 220c2 from the disk. In this manner, the rotation force can be varied or eliminated as desired.

While two balls are used for the rotator according to this invention, it is possible that one ball or three or more balls can be utilized with a rotator disk according to this invention. To generate the desired rotational component of force, at least one of the balls should be located remote from the rotational center 398. As described above, the center line 400 taken through the center of each of the balls is located slightly upstream of the disk's access of rotation 398. The offset O between center 398 and ball rotation line 400 can be 0.031 inch. This slight offset O facilitates the generation of a moment that drives the sheet into the upstream edge guide 212 for more effective rotation. The foregoing has been a detailed description of some possible embodiments of the invention. Various modifications and equivalents are contemplated without departing from the spirit and scope of this invention. For example, while square and rectangular sheets are illustrated herein, justification of non-rectangular, polygonal, sheets is contemplated. Likewise the edge guide can be curved to transport sheets along a non-linear, justified, path. In addition, while herein, a variety of rotating masses, such as rollers on gimbals can be utilized. In some instances, non-moving, low-friction members can be substituted for rotating masses to provide the necessary contact point to generate driving/justifying force vectors. The term "mass" or "freely rotating mass" should be taken to include such non-rotating structures. Accordingly, this description is meant to be taken only by way of example and not to otherwise limit the scope of the invention.

What is claimed is:

1. A sheet rotator comprising:

a supporting surface for supporting sheets and having an upstream end for receiving sheets and a downstream end for outputting sheets;

a rotating surface approximately coplanar with the supporting surface and adjacent the supporting surface, the rotating surface rotating on an axis substantially perpendicular to the supporting surface;

a raised edge guide positioned upstream of the rotating surface and downstream of the rotating surface; and a mass that contacts the rotating surface therewith, the mass having a contact point on the rotating surface that is positioned remote from a center of rotation of the rotating surface constructed and arranged so that each of the sheets entering from the upstream end and passing through the contact point is rotated so that an upstream end of each of the sheets is moved array from the edge guide at a location upstream of the rotating surface and a forward-facing edge of each of the sheets is rotated toward the edge guide at a location downstream of the rotating surface.

2. The rotator as set forth in claim 1 wherein the edge guide defines a pair of remotely-positioned end walls that form a gap located adjacent the rotating surface constructed and arranged so that a corner of each of the sheets passes into the gap as the sheet is rotated.

3. The rotator as set forth in claim 2 further comprising at least a first justifier located upstream of the rotating surface that directs each of the sheets along the edge guide toward the rotating surface.

4. The rotator as set forth in claim 3 wherein the first justifier comprises a first rotating justifier surface having a first freely rotating justifier mass in contact therewith at a location remote from an axis of rotation of the first rotating justifier surface.

5. The rotator as set forth in claim 4 further comprising a movable base, constructed and arranged to move within a predetermined range along an approximately upstream-to-downstream direction relative to the edge guide, the base supporting each of the first rotating justifier surface and the first justifier mass.

6. The rotator as set forth in claim 4 further comprising a second justifier located downstream of the rotating surface for receiving rotated of the sheets from the rotating surface and directing each of the rotated sheets along the edge guide in a downstream direction away from the rotating surface.

7. The rotator as set forth in claim 6 wherein the second justifier comprises a second rotating justifier surface having a second freely rotating justifier mass contacting the second rotating justifier surface remote from an axis of rotation of the second rotating justifier surface and constructed and arranged to direct each of the rotated sheets against the edge guide and to move each of the rotated sheets in a downstream direction.

8. The rotator as, set forth in claim 1 further comprising a base that engages a floor surface and movable supports constructed and arranged to move at least one of an upstream end and a downstream end of the supporting surface toward and away from the floor.

9. The rotator as set forth in claim 8 wherein the movable supports comprise a pair of crossing legs pivotally connected to each of the base and the supporting surface.

10. The rotator as set forth in claim 9 wherein each of the mass and the other mass each comprise a freely rotating mass each having a respective center of rotation and wherein each center of rotation is disposed approximately along a line that is perpendicular to a downstream direction.

11. The rotator as set forth in claim 1 comprising another mass having a contact point on the rotating surface remote from the axis of rotation and remote from the contact point of the mass.

12. The rotator as set forth in claim 11 wherein the line is located upstream of the axis of rotation of the rotating surface.

13. The rotator as set forth in claim 10 wherein at least one freely rotating mass includes a support member constructed and arranged to selectively engage and disengage the at least one freely rotating mass from contact with the rotating surface.

14. The rotator as set forth in claim 13 wherein at least one freely rotating mass comprises a ball and wherein the support member comprises a retaining member having a cylindrical inner surface and a lip that retains the ball from movement toward the rotating surface past the lip.

15. The rotator as set forth in claim 14 wherein at least one retaining member includes another ball located over the ball for generating additional force at a contact point of the ball with the rotating surface.

16. The rotator as set forth in claim 13 wherein the retaining member is constructed and arranged to rotate along an axis perpendicular to the supporting surface and wherein the retaining member includes a stop ring constructed and arranged to selectively engage stops that retain the stop ring at a location in which the ball is disengaged from contact with the disk in a selected rotational orientation of the stop ring.

17. The rotator as set forth in claim 1 further comprising a plurality of justifying rotating surfaces located upstream of the rotating surface and downstream of the rotating surface, each of the justifying rotating surfaces including a freely rotating mass located on each of the rotating surfaces at a location that drives each of the sheets passing therethrough in each of a downstream direction and a direction perpendicular to the downstream direction so that sheets remain in engagement with the edge guide.

18. The rotator as set forth in claim 17 further comprising a plurality of output rollers at the downstream end of the supporting surface.

19. The rotator as set forth in claim 17 wherein each of the plurality of justifying surfaces rotate in a first direction and the rotating surface rotates in an opposite second direction.

20. The rotator as set forth in claim 19 further comprising a central drive motor interconnected with each of the justifying rotating surfaces and the rotating surface by a plurality of drive belts.

21. The rotator as set forth in claim 20 further comprising a connecting belt located between an upstream of the plurality of justifying rotating surfaces and a downstream of the plurality of justifying rotating surfaces and being wrapped around a portion of the rotating surface on a side thereof that causes the rotating surface to rotate in an opposite direction from each of the upstream of the justifying rotating surfaces and the downstream of the justifying rotating surfaces.

22. The rotator as set forth in claim 17 wherein at least one of the upstream of the justifying retaining surfaces is constructed and arranged to move relative to the rotary surface to accommodate differing length sheets therein.

23. The rotator as set forth in claim 22 further comprising a movable base for supporting the at least one of the upstream of the justifying rotating surfaces and an adjustment mechanism for moving the base in an approximately upstream to-downstream direction.

24. The rotator as set forth in claim 23 further comprising a drive belt interconnected with the upstream of the justifying rotating surfaces over a portion of the perimeter of the upstream of the justifying rotating surfaces so that the upstream of the justifying rotating surfaces can move in an upstream-to-downstream direction along a portion of a length of the belt.

25. The rotator as set forth in claim 23 wherein the adjustment mechanism includes a gear rack and a pinion and wherein the base is moved in an upstream-to-downstream direction by rotating the pinion relative to the gear rack.

26. The rotator as set forth in claim 25 wherein the supporting surface includes an orifice defined by an edge constructed and arranged to enable movement of the rotating surface relative to the supporting surface in an upstream-to-downstream direction along the orifice.

27. A method for rotating sheets comprising the steps of:

directing sheets along an edge guide in a downstream direction on a supporting surface to a rotating surface having an axis of rotation substantially perpendicular to a plane defined by the supporting surface;

engaging each of the sheets between the rotating surface and a mass that contacts the rotating surface at a position remote from the axis of rotation of the rotating surface;

generating components of force at a contact point of the mass with the rotating surface that rotates each of the sheets in an area adjacent a corner of each of the sheets including directing the corner into a gap in the edge guide and pivoting the sheets against an end wall that defines the gap;

justifying the sheets upstream of the rotating surface by engaging the sheets with an upstream justifying rotating surface having a freely rotating mass engaging the justifying rotating surface at a position remote from an axis of rotation of the justifying rotating surface:

moving the upstream justifying rotating surface in an upstream-to-downstream direction based upon a size of sheets to be rotated; and receiving each of the rotated sheets at an edge guide located downstream of the rotating surface and driving each of the sheets along the edge guide away from the rotating surface.

28. The method as set forth in claim 27 wherein the step of generating includes directing the corner into a gap in the edge guide and pivoting the sheets against an end wall that defines the gap.

29. The method as set forth in claim 27 further comprising justifying the sheets downstream of the rotating surface by engaging the sheets in a downstream justifying rotating surface having a mass engaging the justifying rotating surface at a location remote from an axis of rotation of the justifying rotating surface and thereby generating components of force that are directed toward the edge guide and downstream along the edge guide.

30. The method as set forth in claim 27 wherein the step of moving comprises locating the upstream justifying rotating surface so that a contact point of the justifying rotating surface with the mass is located to disengage the mass from an upstream edge of each of the sheets passing therethrough as a downstream edge passes into the rotating surface for rotation of each of the sheets.

* * * * *